US009428373B2

(12) United States Patent
Tanaka et al.

(10) Patent No.: US 9,428,373 B2
(45) Date of Patent: Aug. 30, 2016

(54) ROTARY-TYPE FILLING MACHINE AND METHOD FOR CALCULATING FILLING QUANTITY FOR ROTARY-TYPE FILLING MACHINE

(75) Inventors: Yoshiharu Tanaka, Nagoya (JP); Masayuki Hayashi, Nagoya (JP); Shinji Ishikura, Nagoya (JP)

(73) Assignee: MITSUBISHI HEAVY INDUSTRIES FOOD & PACKAGING MACHINE CO., LTD., Nagoya-shi (JP)

( * ) Notice: Subject to any disclaimer, the term of this patent is extended or adjusted under 35 U.S.C. 154(b) by 296 days.

(21) Appl. No.: 13/983,969

(22) PCT Filed: Apr. 6, 2011

(86) PCT No.: PCT/JP2011/058694
§ 371 (c)(1),
(2), (4) Date: Aug. 6, 2013

(87) PCT Pub. No.: WO2012/137317
PCT Pub. Date: Oct. 11, 2012

(65) Prior Publication Data

US 2013/0306190 A1 Nov. 21, 2013

(51) Int. Cl.
*B67C 3/28* (2006.01)

(52) U.S. Cl.
CPC ..... *B67C 3/286* (2013.01); *B67C 3/283* (2013.01); *B67C 3/287* (2013.01)

(58) Field of Classification Search
CPC ..... B67C 3/284; B67C 3/286; B67C 3/288
USPC ..... 141/1, 39, 40, 47, 48, 49, 52, 57, 94, 141/95, 129, 144, 145, 146, 153
See application file for complete search history.

(56) References Cited

U.S. PATENT DOCUMENTS 623,758 A * 4/1899 Zwietusch ..... 141/52
935,685 A * 10/1909 Pindstofte ..... 141/52

(Continued)

FOREIGN PATENT DOCUMENTS

DE 2815980 A1 10/1979
EP 0446920 A2 9/1991

(Continued)

OTHER PUBLICATIONS

Written Opinion of PCT/JP2011/058694, date of mailing Jul. 19, 2011, w/ English translation.

(Continued)

*Primary Examiner* — Mark A. Laurenzi, III
*Assistant Examiner* — Andrew Schmid
(74) *Attorney, Agent, or Firm* — Westerman, Hattori, Daniels & Adrian, LLP

(57) ABSTRACT

A rotary-type filling machine includes a rotary body, a liquid distribution chamber, a plurality of filling flow path configuration units, each of which has a fluid path constituted by a liquid path connected to the liquid distribution chamber and a liquid valve and configured to individually introduce a liquid into a container, a filling control device, a liquid supply unit, a pressure difference information detection unit configured to detect pressure difference information between a liquid distribution chamber pressure, which is a pressure of the liquid in the liquid distribution chamber, and a filling atmospheric pressure detected as a pressure of a flow release unit in a filling flow path configuration unit at an arbitrary radial direction position of the rotary body, and a rotation information detection unit configured to detect rotation information of the rotary body.

10 Claims, 17 Drawing Sheets

(56) References Cited

U.S. PATENT DOCUMENTS

| | | | | |
|---|---|---|---|---|
| 1,148,574 | A * | 8/1915 | Caspare | 141/6 |
| 1,154,746 | A * | 9/1915 | Champ | 141/52 |
| 1,722,420 | A * | 7/1929 | Horton | 141/1 |
| 1,985,767 | A * | 12/1934 | De Markus | 141/49 |
| 2,012,247 | A * | 8/1935 | Muller | 141/47 |
| 2,138,355 | A * | 11/1938 | Miles et al. | 141/48 |
| 2,147,366 | A * | 2/1939 | Fagan et al. | 141/13 |
| 2,187,332 | A * | 1/1940 | Sinz | 141/6 |
| 2,367,899 | A * | 1/1945 | Stewart | 141/6 |
| 2,536,746 | A * | 1/1951 | Hollifield | 141/39 |
| 2,723,790 | A * | 11/1955 | Spiess, Jr. et al. | 141/3 |
| 2,756,916 | A * | 7/1956 | Kerr | 141/146 |
| 2,862,528 | A * | 12/1958 | Geisler | 141/39 |
| 2,898,953 | A * | 8/1959 | Berthelsen et al. | 141/48 |
| 3,182,691 | A * | 5/1965 | Vergobbi et al. | 141/5 |
| 3,252,486 | A * | 5/1966 | Mallrich | 141/50 |
| 3,527,267 | A * | 9/1970 | Moore | 141/40 |
| 3,552,453 | A * | 1/1971 | Ball et al. | 141/7 |
| 3,578,038 | A * | 5/1971 | Burford | 141/7 |
| 3,951,186 | A * | 4/1976 | Mencacci | 141/5 |
| 4,053,003 | A * | 10/1977 | Ferrero et al. | 141/144 |
| 4,103,721 | A * | 8/1978 | Noguchi | 141/6 |
| 4,442,873 | A * | 4/1984 | Yun | 141/39 |
| 4,467,846 | A * | 8/1984 | Croser | 141/47 |
| 4,630,654 | A * | 12/1986 | Kennedy, Jr. | 141/83 |
| 4,691,496 | A * | 9/1987 | Anderson et al. | 53/53 |
| 4,913,198 | A * | 4/1990 | Hayahara et al. | 141/83 |
| 5,031,673 | A * | 7/1991 | Clusserath | 141/6 |
| 5,313,990 | A * | 5/1994 | Clusserath | 141/6 |
| 5,372,167 | A * | 12/1994 | Hirose et al. | 141/39 |
| 5,413,686 | A * | 5/1995 | Klein et al. | 204/603 |
| 5,642,761 | A * | 7/1997 | Holbrook | 141/104 |
| 5,713,403 | A * | 2/1998 | Clusserath et al. | 141/101 |
| 5,819,816 | A * | 10/1998 | Mayer | 141/83 |
| 5,875,824 | A * | 3/1999 | Atwell et al. | 141/67 |
| 5,947,167 | A * | 9/1999 | Bogen et al. | 141/1 |
| 5,960,838 | A * | 10/1999 | Tietz et al. | 141/89 |
| 6,058,985 | A * | 5/2000 | Petri et al. | 141/168 |
| 6,079,460 | A * | 6/2000 | Ballan et al. | 141/145 |
| 6,155,314 | A * | 12/2000 | Ding et al. | 141/285 |
| 6,189,578 | B1 * | 2/2001 | Clusserath | 141/7 |
| 6,192,946 | B1 * | 2/2001 | Clusserath | 141/40 |
| 6,213,169 | B1 * | 4/2001 | Clusserath | 141/49 |
| 6,457,495 | B1 * | 10/2002 | Meheen | 141/40 |
| 6,470,922 | B2 * | 10/2002 | Sindermann | 141/37 |
| 6,983,577 | B2 * | 1/2006 | Hartness et al. | 53/471 |
| 7,017,623 | B2 * | 3/2006 | Tribble et al. | 141/27 |
| 7,117,902 | B2 * | 10/2006 | Osborne | 141/27 |
| 7,308,917 | B2 * | 12/2007 | Krulitsch | 141/198 |
| 7,347,231 | B2 * | 3/2008 | Schmoll | 141/52 |
| 7,497,237 | B2 * | 3/2009 | Till | 141/5 |
| 7,721,773 | B2 * | 5/2010 | Stadlmayr et al. | 141/302 |
| 7,814,940 | B2 * | 10/2010 | Till et al. | 141/11 |
| 8,479,782 | B2 * | 7/2013 | Mastio et al. | 141/89 |
| 8,955,560 | B2 * | 2/2015 | Clusserath | 141/59 |
| 9,010,381 | B2 * | 4/2015 | Clusserath | 141/6 |
| 2001/0045242 | A1 * | 11/2001 | Clusserath et al. | 141/144 |
| 2002/0014276 | A1 * | 2/2002 | Clusserath | 141/40 |
| 2003/0150514 | A1 * | 8/2003 | De Villele | 141/144 |
| 2004/0112460 | A1 * | 6/2004 | Stocchi | 141/144 |
| 2004/0231748 | A1 * | 11/2004 | Friede | 141/144 |
| 2004/0238065 | A1 * | 12/2004 | Loffler | 141/145 |
| 2005/0016624 | A1 * | 1/2005 | Till | 141/144 |
| 2005/0034779 | A1 * | 2/2005 | Bernhard | 141/90 |
| 2005/0045244 | A1 * | 3/2005 | Hartness et al. | 141/144 |
| 2005/0121104 | A1 * | 6/2005 | Monzel | 141/144 |
| 2005/0217753 | A1 * | 10/2005 | Krulitsch | 141/146 |
| 2005/0241726 | A1 * | 11/2005 | Clusserath et al. | 141/144 |
| 2006/0266003 | A1 * | 11/2006 | Topf et al. | 53/281 |
| 2007/0000570 | A1 * | 1/2007 | Lechner et al. | 141/144 |
| 2007/0006939 | A1 * | 1/2007 | Clusserath | 141/40 |
| 2007/0029002 | A1 * | 2/2007 | Bernhard et al. | 141/144 |
| 2007/0193652 | A1 * | 8/2007 | Till et al. | 141/144 |
| 2008/0134633 | A1 * | 6/2008 | Zwilling | 53/135.1 |
| 2008/0314476 | A1 * | 12/2008 | Bernhard | 141/129 |
| 2009/0095370 | A1 * | 4/2009 | Krulitsch | 141/6 |
| 2010/0006174 | A1 * | 1/2010 | Till | 141/1 |
| 2010/0037988 | A1 * | 2/2010 | Wilhelm et al. | 141/129 |
| 2010/0071803 | A1 * | 3/2010 | Clusserath et al. | 141/65 |
| 2010/0212773 | A1 * | 8/2010 | Clusserath et al. | 141/6 |
| 2013/0240081 | A1 * | 9/2013 | Balzarin et al. | 141/7 |
| 2013/0306190 | A1 * | 11/2013 | Tanaka et al. | 141/1 |
| 2014/0174597 | A1 * | 6/2014 | D'Errico et al. | 141/47 |

FOREIGN PATENT DOCUMENTS

| | | | |
|---|---|---|---|
| EP | 0974548 | A1 | 1/2000 |
| EP | 1127835 | A1 | 8/2001 |
| EP | 1739050 | A2 | 1/2007 |
| JP | 59-32460 | A | 2/1984 |
| JP | 60-90192 | A | 5/1985 |
| JP | 61-93095 | A | 5/1986 |
| JP | 62-52095 | A | 3/1987 |
| JP | 2-219702 | A | 9/1990 |
| JP | 5-32292 | A | 2/1993 |
| JP | 07-300196 | A | 11/1995 |
| JP | 09-2584 | A | 1/1997 |
| JP | 9-40087 | A | 2/1997 |
| JP | 9-40088 | A | 2/1997 |
| JP | 09-95394 | A | 4/1997 |
| JP | 9-156697 | A | 6/1997 |
| JP | 2633820 | B2 | 7/1997 |
| JP | 9-278017 | A | 10/1997 |
| JP | 10-120089 | A | 5/1998 |
| JP | 2817192 | B2 | 10/1998 |
| JP | 11-79289 | A | 3/1999 |
| JP | 11-193094 | A | 7/1999 |
| JP | 2000-128283 | A | 5/2000 |
| JP | 2001-261096 | A | 9/2001 |
| JP | 2001-287796 | A | 10/2001 |
| JP | 2005-298047 | A | 10/2005 |
| JP | 2006-335382 | A | 12/2006 |
| JP | 2007-197062 | A | 8/2007 |
| JP | 2009-190770 | A | 8/2009 |
| JP | 2013-107683 | A | 6/2013 |
| WO | 97/00224 | A1 | 1/1997 |

OTHER PUBLICATIONS

Extended European Search Report dated Dec. 1, 2014, issued in European Application No. 11862927.8. (10 pages).

International Search Report dated Jul. 19, 2011, issued in corresponding applcation No. PCT/JP2011/058694.

Decision to Grant a Patent dated Apr. 7, 2016, issued in counterpart European Patent Application No, 11862927.8. (2 pages).

* cited by examiner

ROTARY-TYPE FILLING MACHINE AND METHOD FOR CALCULATING FILLING QUANTITY FOR ROTARY-TYPE FILLING MACHINE

TECHNICAL FIELD

The present invention relates to a rotary-type filling machine and a method for calculating a filling quantity for a rotary-type filling machine.

BACKGROUND ART

In a rotary-type filling machine according to the related art, in order to improve cost characteristics or maintenance characteristics, accurate filling of a predetermined amount of liquid by a filling method or apparatus is needed without it being necessary to install a measurement unit at each filling valve.

Such a rotary-type filling machine is disclosed in the following Patent Literature 1.

In the following Patent Literature 1, a container is held by a container-holding section of a rotary column and moved along a circular filling path, liquid is filled into the container from a filling start position through a filling valve at a large flow rate for a predetermined filling time, a liquid surface height of the container is detected at a level detection position on the filling path by a level sensor, a remaining supplement filling quantity and a small flow rate filling time are calculated from a difference between a target liquid surface height and the measured liquid surface height, and then liquid is filled into the container from the filling valve at a small flow rate for a small flow rate filling time. As the flow rate and the filling quantity during the small flow rate filling are sufficiently reduced, even when a container portion into which the large flow rate filling is performed is deformed, the liquid surface in the container is constantly controlled with sufficient accuracy. As described above, a filling apparatus using a timer and a unit configured to measure a liquid surface height without a gauge or a load cell installed at each filling valve is disclosed.

In addition, a fixed type filling machine is disclosed in the following Patent Literature 2.

According to Patent Literature 2, in the fixed filling machine including a filling needle configured to inject liquid into a container, a manifold connected to the filling needle and in which the liquid is stored, and an on-off valve configured to open and close a flow path between the filling needle and the manifold, a liquid pressure is measured at a predetermined period using a pressure gauge installed at the manifold, and a filling quantity is calculated from the measured pressure and a pressure-filling quantity function. Then, the calculated result is integrated, and the on-off valve is closed when the integrated result arrives at a target filling quantity, terminating the filling.

According to the configuration, the liquid can be filled without installation of a flowmeter or a load cell at each filling valve.

CITATION LIST

Patent Literature

[Patent Literature 1] Japanese Unexamined Patent Application, First Publication No. H10-120089

[Patent Literature 2] Japanese Patent No. 2633820

SUMMARY OF INVENTION

Problem to be Solved by the Invention

However, the technique of the related art of Patent Literature 1 is a method using the timer and the sensor as the unit configured to measure the filling quantity instead of the flowmeter or the load cell. Accordingly, the related art cannot be applied when the liquid surface of the filling liquid cannot be accurately detected, for example, due to a material or a color of the container (an opaque container or the like), or an error of the liquid surface caused by bubbles on the liquid surface.

In addition, when the technique of the related art of Patent Literature 2 is applied to the rotary-type filling machine, an error occurs due to a centrifugal force generated according to an operating speed of the filling machine, and thus the filling quantity of the liquid cannot be accurately controlled.

In consideration of the above-mentioned circumstances, an object of the present invention is to provide a rotary-type filling machine capable of accurately calculating a filling flow rate with a simple configuration. Another object of the present invention is to provide a rotary-type filling machine capable of accurately controlling a filling quantity based on a calculation result.

Solution to Problem

The above-mentioned objects can be accomplished by the following features of the present invention.

That is, a rotary-type filling machine according to the present invention includes a rotary body rotatable about a rotation central axis; a liquid distribution chamber installed at the rotary body and configured to store a liquid supplied from the outside; a plurality of filling flow path configuration units arranged about the rotation central axis in the rotary body, each of which has a fluid path constituted by a liquid path connected to the liquid distribution chamber and a liquid valve installed at the liquid path and configured to individually introduce the liquid into a container; a filling control device configured to control the respective liquid valves and control a filling quantity of the liquid with respect to the container; and a liquid supply unit installed at a fixing section and configured to supply the liquid into the liquid distribution chamber, wherein the rotary-type filling machine has a pressure difference information detection unit configured to detect pressure difference information between a liquid distribution chamber pressure, which is a pressure of the liquid in the liquid distribution chamber, and a filling atmospheric pressure detected as a pressure of a flow release unit in the filling flow path configuration unit at an arbitrary radial direction position of the rotary body, and a rotation information detection unit configured to detect rotation information of the rotary body, wherein the filling control device calculates a flow rate of the liquid flowing out of a liquid outlet of the liquid path based on the detected pressure difference information and rotation information, and a relationship between the previously obtained pressure difference information and rotation information and the flow rate of the liquid flowing out of the liquid outlet of the liquid path, and controls a filling quantity of the liquid with respect to the container.

According to the above-mentioned configuration, since the flow rate of the liquid from the liquid outlet of the liquid path of the filling flow path configuration unit (the fluid flow path) is obtained from the detected pressure difference information and rotation information based on the previously obtained relationship of flow rate of the liquid in the liquid outlet of the liquid path of the filling flow path configuration unit (the fluid flow path), rotation information and pressure difference information, the flow rate of the liquid that receives the centrifugal force by the rotation in the filling flow path configuration unit (the fluid flow path) can be obtained. Accordingly, it is not necessary to install a flowmeter, a load cell, or the like, at each of the filling flow path configuration units, and the filling quantity can be accurately controlled with a simple configuration.

In addition, for "the previously obtained relationship of the pressure difference information, the rotation information and the flow rate of the liquid flowing from the liquid outlet of the liquid path", for example, a function obtaining the flow rate of the liquid flowing from the liquid outlet section using a pressure difference and rotation information as variables can be used.

In addition, a rotary-type filling machine includes: a rotary body rotatable about a rotation central axis; a liquid distribution chamber installed at the rotary body and configured to store a liquid supplied from the outside; a plurality of filling flow path configuration units arranged about the rotation central axis in the rotary body, each of which has a fluid path constituted by a liquid path connected to the liquid distribution chamber and a liquid valve installed at the liquid path and configured to individually introduce the liquid into a container; a filling control device configured to control the respective liquid valves and control a filling quantity of the liquid with respect to the container; and a liquid supply unit installed at a fixing section and configured to supply the liquid into the liquid distribution chamber, wherein the rotary-type filling machine has a pressure difference information detection unit configured to detect pressure difference information between a liquid distribution chamber pressure, which is a pressure of the liquid in the liquid distribution chamber, and a filling atmospheric pressure of the container detected as a pressure of a flow release unit in the filling flow path configuration unit at substantially the same radial direction position as a liquid outlet of the liquid path of the rotary body, wherein the filling control device calculates a flow rate of the liquid flowing from the liquid outlet of the liquid path based on the detected pressure difference information, and a relationship between the previously obtained pressure difference information and the flow rate of the liquid flowing from the liquid outlet of the liquid path, and controls a filling quantity of the liquid with respect to the container.

According to the above-mentioned configuration, since the flow rate of the liquid from the liquid outlet of the liquid path of the filling flow path configuration unit (the fluid flow path) is obtained from the detected pressure difference information, based on the previously obtained relationship of the flow rate of the liquid in the liquid outlet of the liquid path of the filling flow path configuration unit (the fluid flow path) and the pressure difference information, the flow rate of the liquid that receives the centrifugal force by the rotation in the filling flow path configuration unit (the fluid flow path) can be obtained. Accordingly, it is not necessary to install a flowmeter, a load cell, or the like, at each of the filling flow path configuration units, and the filling quantity can be accurately controlled with a simple configuration.

That is, since a detection of the rotation information is not necessary to control the filling quantity of the liquid into the container, the apparatus can be more simply configured.

In addition, a rotary-type filling machine includes: a rotary body rotatable about a rotation central axis; a liquid distribution chamber installed at the rotary body and configured to store a liquid supplied from the outside; a plurality of filling flow path configuration units arranged about the rotation central axis in the rotary body, each of which has a fluid path constituted by a liquid path connected to the liquid distribution chamber and a liquid valve installed at the liquid path, a sealing tool configured to seal a filling atmosphere in a container, a return gas path configured to guide a return gas during the filling from the container into a return gas chamber which is pressure-controlled and a return gas valve installed at the return gas path, and configured to individually guide a liquid into the container; a pressurized gas path configured to supply a pressure-controlled gas with respect to the container and a pressurized gas valve installed at the pressurized gas path; a discharge gas path configured to discharge a pressurized gas remaining in the container and the sealing tool upon completion of the filling and a discharge gas valve installed at the discharge gas path; a filling control device configured to control the respective liquid valves and control a filling quantity of the liquid with respect to the container; and a liquid supply unit installed at a fixing section and configured to supply the liquid into the liquid distribution chamber, wherein the rotary-type filling machine has a pressure difference information detection unit configured to detect pressure difference information between a liquid distribution chamber pressure, which is a pressure of the liquid in the liquid distribution chamber, and a return gas chamber pressure of the return gas chamber detected as a pressure of a flow release unit in the filling flow path configuration unit at an arbitrary radial direction position of the rotary body, and a rotation information detection unit configured to detect rotation information of the rotary body, wherein the filling control device calculates a flow rate of the liquid flowing out of a liquid outlet of the liquid path based on the detected pressure difference information and rotation information, and a previously obtained relationship between the pressure difference information and rotation information and the flow rate of the liquid flowing out of the liquid outlet of the liquid path, and controls a filling quantity of the liquid with respect to the container.

According to the above-mentioned configuration, since the flow rate of the liquid from the liquid outlet of the liquid path of the filling flow path configuration unit (the fluid flow path) is obtained from the detected pressure difference information based on the previously obtained relationship of the flow rate of the liquid in the liquid outlet of the liquid path of the filling flow path configuration unit (the fluid flow path) and the pressure difference information, the flow rate of the gas-filled liquid that receives the centrifugal force by the rotation in the fluid flow path can be obtained. Accordingly, it is not necessary to install a flowmeter, a load cell, or the like, at each of the filling flow path configuration units, and the filling quantity can be accurately controlled with a simple configuration.

In addition, a rotary-type filling machine includes: a rotary body rotatable about a rotation central axis; a liquid distribution chamber installed at the rotary body and configured to store a liquid supplied from the outside; a plurality of filling flow path configuration units arranged about the rotation central axis in the rotary body, each of which has a fluid path constituted by a liquid path connected to the liquid distribution chamber and a liquid valve installed at the liquid path, and a sealing tool configured to seal a filling atmosphere in a container, a return gas path configured to guide a return gas during the filling from the container into a return gas chamber which is pressure-controlled and a return gas valve installed at the return gas path, and configured to individually guide a liquid into the container; a pressurized gas path configured to supply a pressure-controlled gas with respect to the container and a pressurized gas valve installed at the pressurized gas path; a discharge gas path configured to discharge a pressurized gas remaining in the container and the sealing tool upon completion of the filling and a discharge gas valve installed at the discharge gas path; a filling control device configured to control the respective liquid valves and control a filling quantity of the liquid with respect to the container; and a liquid supply unit installed at a fixing section and configured to supply the liquid into the liquid distribution chamber, wherein the rotary-type filling machine has a pressure difference information detection unit configured to detect pressure difference information between a liquid distribution chamber pressure, which is a pressure of the liquid in the liquid distribution chamber, and a return gas chamber pressure of the return gas chamber detected as a pressure of a flow release unit in the filling flow path configuration unit at substantially the same radial direction position as a liquid outlet of the liquid path of the rotary body, wherein the filling control device calculates a flow rate of the liquid flowing from the liquid outlet of the liquid path based on the detected pressure difference information, and a previously obtained relationship between the pressure difference information and the flow rate of the liquid flowing from the liquid outlet of the liquid path, and controls a filling quantity of the liquid with respect to the container.

According to the above-mentioned configuration, since the flow rate of the liquid from the liquid outlet of the liquid path of the filling flow path configuration unit (the fluid flow path) is obtained from the detected pressure difference information based on the previously obtained relationship between the flow rate of the liquid in the liquid outlet of the liquid path of the filling flow path configuration unit (the fluid flow path) and the pressure difference information, the flow rate of the gas-filled liquid that receives the centrifugal force by the rotation in the fluid flow path can be obtained. Accordingly, it is not necessary to install a flowmeter, a load cell, or the like, at each of the filling flow path configuration units is removed, and the filling quantity can be accurately controlled with a simple configuration.

That is, since the detection of the rotation information is not necessary to control the filling quantity of the liquid into the container, the apparatus can be more simply configured.

In addition, it is preferable that the liquid distribution chamber is filled with the liquid.

According to the above-mentioned configuration, since the liquid distribution chamber is filled with the liquid, the liquid distribution chamber pressure can be easily obtained from various places of the liquid distribution chamber.

Further, it is preferable that a liquid phase by the liquid and a gaseous phase by a gas are formed in the liquid distribution chamber, and a liquid level control unit configured to control a liquid level of the liquid in the liquid distribution chamber is provided between the liquid distribution chamber and the liquid supply unit.

According to the above-mentioned configuration, even in the configuration in which the gaseous phase is formed in the liquid distribution chamber, the filling quantity can be accurately controlled.

In addition, the pressure difference information detection unit may include; a first detection body installed at the liquid distribution chamber and configured to detect the liquid distribution chamber pressure; a second detection body installed at the rotary body and spaced apart from the first detection body, and configured to detect a pressure of the flow release unit of the filling flow path configuration unit; a pair of capillary tubes, each of which is connected to one of the first detection body and the second detection body, and in which an enclosed liquid is enclosed; and a detector main body configured to output a difference between a pressure transmitted from the first detection body and a pressure transmitted from the second detection body as the pressure difference information via the pair of capillary tubes.

According to the above-mentioned configuration, since the pair of capillary tubes, each of which is connected to one of the first detection body and the second detection body, are provided, detection positions of the pressure difference information can be variously selected. Accordingly, a degree of design freedom of the rotary-type filling machine can be improved.

In addition, the pressure difference information detection unit may include: a first detection unit installed at the liquid distribution chamber and configured to detect the liquid distribution chamber pressure; and a second detection unit installed at substantially the same radial direction position as the first detection unit and configured to detect a pressure of the flow release unit of the filling flow path configuration unit.

According to the above-mentioned configuration, since the pressure difference information detection unit is installed at the liquid distribution chamber, the apparatus can be simply configured.

In addition, in a method of calculating a filling quantity for a rotary-type filling machine according to the present invention, the machine including: a rotary body rotatable about a rotation central axis; a liquid distribution chamber installed at the rotary body and configured to store a liquid supplied from the outside; a plurality of filling flow path configuration units arranged about the rotation central axis in the rotary body, each of which has a fluid path constituted by a liquid path connected to the liquid distribution chamber and a liquid valve installed at the liquid path and configured to individually introduce the liquid into a container; and a liquid supply unit installed at a fixing section and configured to supply the liquid into the liquid distribution chamber, the method includes: an information detecting process of detecting pressure difference information of a pressure of an inlet side of a flow in the filling flow path configuration unit and a pressure of a release side of the flow of a flow release unit side in the filling flow path configuration unit, and rotation information of the rotary body; and a calculating process of obtaining a flow rate of the liquid flowing from a liquid outlet of the liquid path based on the detected pressure difference information and the rotation information, and a previously obtained relationship between the pressure difference information and rotation information and the flow rate of the liquid flowing from the liquid outlet of the liquid path.

In this way, since the flow rate of the liquid from the liquid outlet of the liquid path of the filling flow path configuration unit (the fluid flow path) is obtained from the detected pressure difference information and rotation information based on the previously obtained relationship of the flow rate of the liquid in the liquid outlet of the liquid path of the filling flow path configuration unit (the fluid flow path), the rotation information and the pressure difference information, the flow rate of the liquid that receives the centrifugal force by the rotation in the fluid flow path can be obtained.

In addition, in a method of calculating a filling quantity for a rotary-type filling machine, the machine including: a rotary body rotatable about a rotation central axis; a liquid distribution chamber installed at the rotary body and configured to store a liquid supplied from the outside; a plurality of filling flow path configuration units arranged about the rotation central axis in the rotary body, each of which has fluid path constituted by a liquid path connected to the liquid distribution chamber and a liquid valve installed at the liquid path and configured to individually introduce the liquid into a container; and a liquid supply unit installed at a fixing section and configured to supply the liquid into the liquid distribution chamber, the method comprises: an information detecting process of detecting pressure difference information of a pressure of an inlet side of a flow in the filling flow path configuration unit and a pressure of a release side of a flow of a flow release unit side in the filling flow path configuration unit at substantially the same radial direction position as an outlet of the liquid path; and a calculating process of obtaining a flow rate of the liquid flowing from a liquid outlet of the liquid path based on the detected pressure difference information, and a previously obtained relationship between the pressure difference information and the flow rate of the liquid flowing from the liquid outlet of the liquid path.

In this way, since the flow rate of the liquid from the liquid outlet of the liquid path of the filling flow path configuration unit (the fluid flow path) is obtained from the detected pressure difference information based on the previously obtained relationship of the flow rate of the liquid in the liquid outlet of the liquid path of the filling flow path configuration unit (the fluid flow path) and the pressure difference information, the flow rate of the liquid that receives the centrifugal force by the rotation in the fluid flow path can be obtained.

Advantageous Effects of Invention

According to the present invention, in the rotary-type filling machine, the filling flow rate can be accurately calculated with a simple configuration. Further, the filling quantity can be accurately controlled based on the calculated result.

DESCRIPTION OF EMBODIMENTS

Hereinafter, embodiments of the present invention will be described with reference to the accompanying drawings.

[First Embodiment]

Hereinafter, a first embodiment of the present invention will be described with reference to the accompanying drawings.

Figure 1:
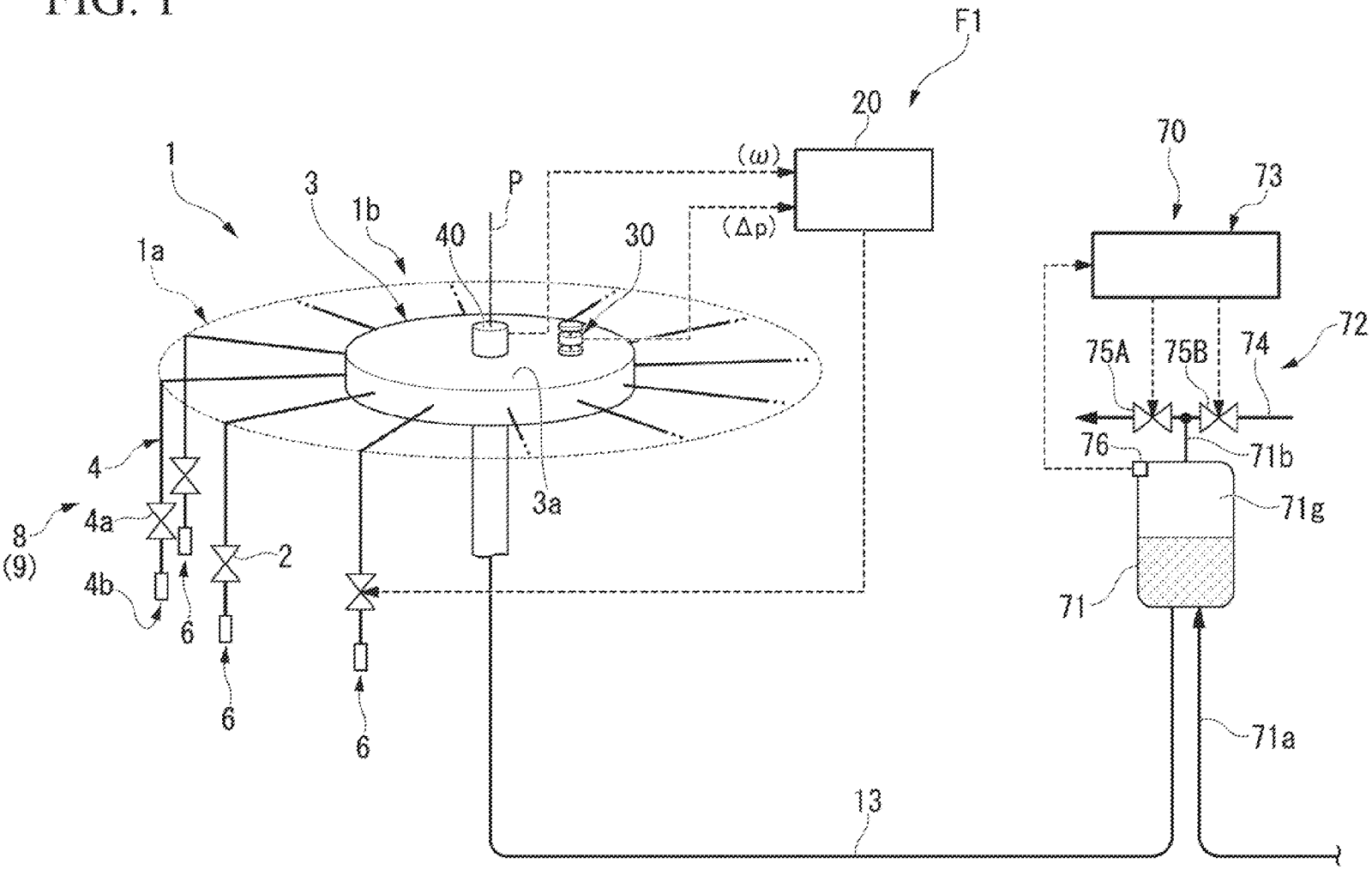
FIG. 1 is a schematic perspective view of a rotary-type filling machine F1 according to a first embodiment of the present invention.
Figure 2:
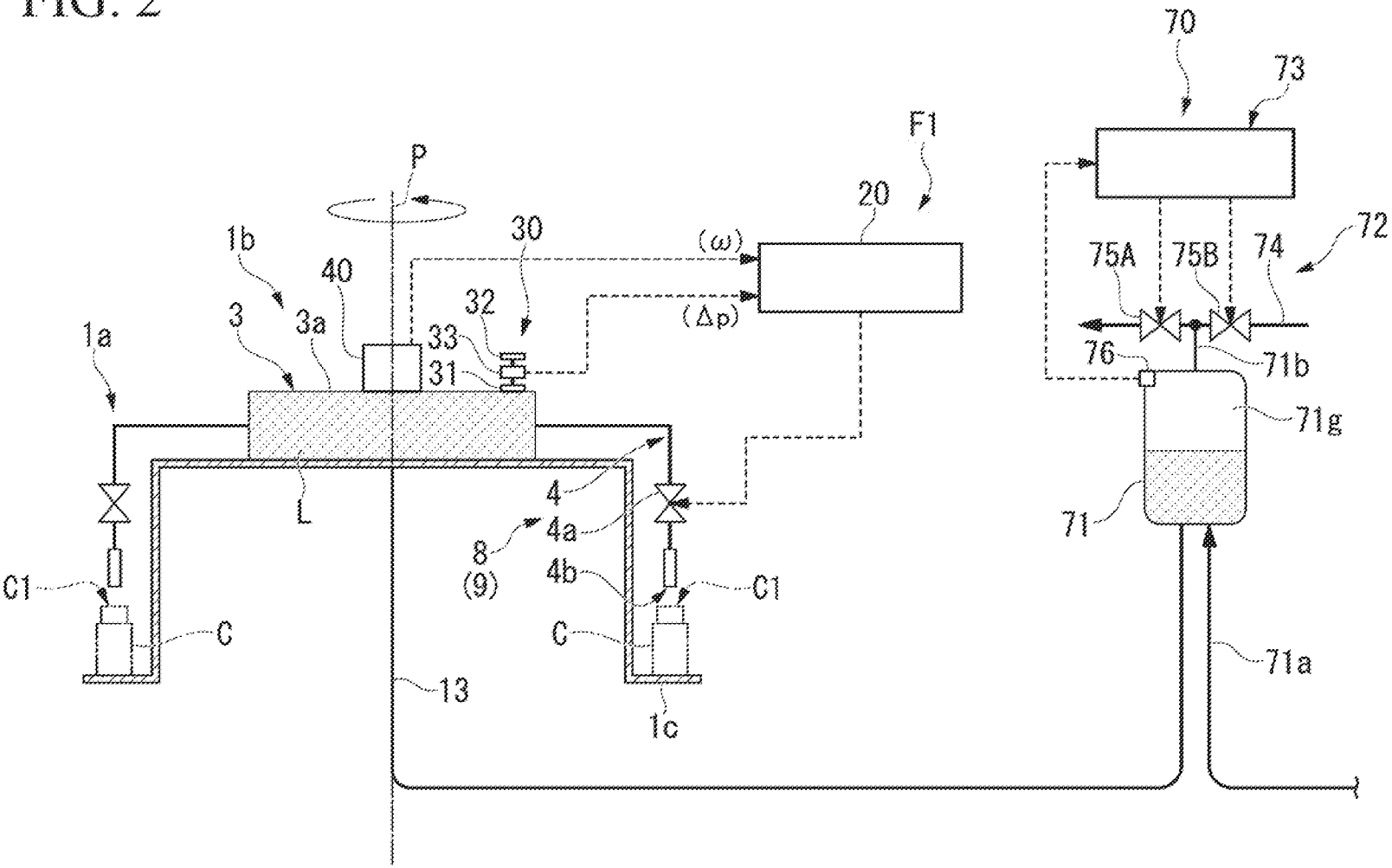
FIG. 2 is a schematic configuration view of the rotary-type filling machine F1 according to the first embodiment of the present invention.

FIG. 1 is a schematic perspective view of a rotary-type filling machine F1 according to the first embodiment of the present invention, and FIG. 2 is a schematic configuration view of the rotary-type filling machine F1.

As shown in FIGS. 1 and 2, the rotary-type filling machine F1 is configured to fill a liquid L into a container C in a state in which a mouth section C1 of the container C is not sealed, i.e., a non-sealed state, and includes a rotary body 1, a liquid supply unit 70 configured to supply the liquid L into the rotary body 1, a filling control device (a filling quantity control unit) 20 configured to control a liquid valve 4*a* of a filling flow path configuration unit 8 configured to control a filling quantity of the liquid L, a pressure difference detector (a pressure difference information detection unit) 30, and a revolution indicator (a rotation information detection unit) 40.

In addition, in many cases, filling (non-sealed filling) in the non-sealed state is performed when a non-gas beverage containing (basically) little carbon dioxide gas in the liquid is filled into the container C.

The rotary body 1 includes a plurality of filling flow path configuration units 8 disposed in an outer circumferential section 1*a* of the rotary body 1 about a rotation central axis P at equal intervals, a liquid distribution chamber 3 connected to the plurality of filling flow path configuration units 8, and a seating table 1*c* (not shown in FIG. 1) on which the container C introduced into the rotary body 1 is placed.

The liquid distribution chamber 3 is disposed on the rotation central axis P in a central section 1*b* of the rotary body 1, and distributes the liquid L supplied from the liquid supply unit 70 to the respective filling flow path configuration units 8.

As shown in FIG. 1, each of the filling flow path configuration units 8 include a liquid path 4 connected to the liquid distribution chamber 3, and a liquid valve 4*a* installed at the liquid path 4.

The liquid path 4 has a base end side connected to the liquid distribution chamber 3 and a tip side at which a liquid outlet 4*b* is formed, and extends radially outward from the liquid distribution chamber 3 and then extends downward. The liquid outlet 4*b* of the liquid path 4 is disposed on the same central axis of an opening section of the container C introduced onto the seating table 1*c*, and opened toward the seating table 1*c* (see FIG. 2).

The liquid valve 4*a* is installed on the liquid path 4 and on-off controlled by the filling control device 20.

According to the above-mentioned configuration, in each of the filling flow path configuration units 8, a fluid path 9 configured to separately guide the liquid L into the container C is constituted by the liquid path 4 and the liquid valve 4*a*.

The liquid supply unit 70 includes a liquid reservoir section 71 configured to control and store a liquid level (a level) of the liquid L conveyed from the outside and accumulated in a conventional method (not shown), and a liquid supply pressure control unit 72 configured to set and adjust a pressure required to convey the liquid L to the liquid distribution chamber 3.

The liquid reservoir section 71 is installed at a fixing section of the outside of the rotary body 1, has a gaseous phase section 71*g* formed at an upper portion thereof, is connected to a liquid supply pipe 71*a* configured to supply the liquid L from the outside, and is connected to the liquid distribution chamber 3 of the rotary body 1 via a rotary joint (not shown) and a liquid feed line 13.

The liquid supply pressure control unit 72 is constituted by an extraction steam pipe 71*b* connected to the gaseous phase section 71*g*, a pressure regulating valve 75B for air supply connected between a gas supply pipe 74 and the extraction steam pipe 71*b*, a pressure regulating valve 75A for air exhaust connected to the extraction steam pipe 71*b* side, a pressure sensor 76 installed at the gaseous phase section 71*g*, and a pressure control device 73 configured to control the pair of pressure regulating valves 75A and 75B and regulate a pressure of the liquid supply unit 70 based on the pressure detected from the pressure sensor 76. The pressure control device 73 regulates a pressure of a gas of the liquid supply unit 70, and supplies the liquid L into the liquid distribution chamber 3 via the liquid feed line 13. In addition, in the embodiment, while the pressure sensor 76 is installed at the gaseous phase section 71*g*, the pressure sensor 76 may be installed at the liquid reservoir section 71 or the liquid feed line 13.

The filling control device 20 calculates a flow rate flowing from the liquid outlet 4*b* of the liquid path 4 from a revolution speed (an angular velocity, rotation information) ω of the rotary body 1 detected by the revolution indicator 40 and a pressure difference (pressure difference information) Δp detected by the pressure difference detector 30, and controls the filling quantity of the liquid L with respect to the container C.

Figure 3:
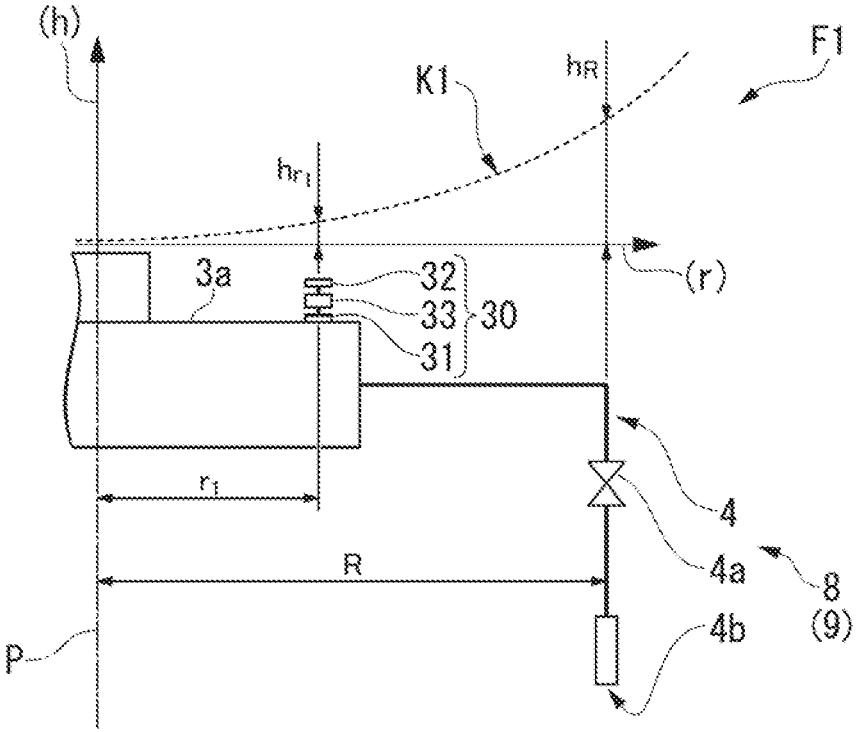
FIG. 3 is a view showing a relationship between a situation in which a water head rises due to a centrifugal force and an installation position of a pressure difference detector in the rotary-type filling machine F1 according to the first embodiment of the present invention.

FIG. 3 is a view showing a relationship between a water head rise caused by a centrifugal force and an installation position of the pressure difference detector 30 in the rotary-type filling machine F1.

The pressure difference detector 30 is configured to detect the pressure difference Δp between a liquid distribution chamber pressure, which is a pressure of the liquid L in the liquid distribution chamber 3, and an atmospheric pressure (the filling atmospheric pressure=a pressure in the container C, which is a flow release unit of the filling flow path configuration unit 8), which is a pressure of the atmosphere for filling the liquid L, and includes a first detection unit 31, a second detection unit 32 and a detector main body 33, which are integrally formed with each other. As shown in FIG. 3, the pressure difference detector 30 is installed at a position where a radial direction distance r is apart from the rotation central axis P with an amount of r1 (hereinafter referred to as an installation position r1) in a partition wall 3*a* configured to partition the liquid distribution chamber 3, and at the installation position r1, the first detection unit 31 is configured to receive a liquid distribution chamber pressure and the second detection unit 32 is configured to receive the atmospheric pressure. Then, the detector main body 33 outputs the detected pressure difference Δp obtained by subtracting the pressure at the second detection unit 32 from the pressure at the first detection unit 31 to the filling control device 20.

In addition, the inside of the liquid distribution chamber 3 is designed to be fully filled with the liquid L such that a water head increment can be detected by rotation at the position of the first detection unit 31.

The revolution indicator 40 is installed on the rotation central axis P of the rotary body 1, is rotated with the rotary body 1, detects the revolution speed ω of the rotary body 1, and outputs the detected revolution speed ω to the filling control device 20.

Next, an operation of the above-mentioned rotary-type filling machine F1 will be described.

Generally, a flow rate (a filling flow rate) Q of the liquid L flowing through the liquid path 4 in a non-rotation-type filling machine can be calculated from characteristics of the liquid L such as a specific weight, a liquid temperature, or the like, flow characteristics obtained from a dimension and a shape of a flow path of the filling flow path configuration unit 8, and the pressure difference Δp between a liquid inlet section and a liquid outlet section (the liquid outlet 4*b*=atmospheric pressure) of the liquid path 4.

Here, since the characteristics of the liquid L and the flow characteristics of the filling flow path configuration unit 8 (the fluid path 9) are not varied when the liquid L to be filled and the structure of the filling machine are determined, eventually, the flow rate Q of the liquid path 4 in a non-rotating state can be calculated using only the pressure difference (Δp) as a parameter as follows:

$$\text{Flow rate } Q=f'(\Delta p)$$

where, f': a flow rate property function of a filling flow path configuration unit.

Meanwhile, in case in which the rotary body 1 is rotated in the rotary-type filling machine F1, when the number of revolutions is increased, in comparison with the flow rate Q obtained from the flow rate property function f' of the filling flow path configuration unit, the actual flow rate Q is increased. This is because the water head rises due to the centrifugal force such that the situation occurs in which the water head rises as shown in the rotary body 1 of FIG. 3.

A water head increment h caused by the rotation is increased according to an increase in the radial direction distance r from the rotation central axis P of the rotary body 1 as shown in FIG. 3 with respect to the rotation central axis P of the rotary body 1, and is increased according to an increase in revolution speed ω.

Expressing these in an equation, the water head increment h caused by the rotation is calculated as a function h(r, ω) of the radial direction distance r and the revolution speed ω.

Accordingly, the water head increment $h_{r1}$ caused by the rotation at the installation position r1 of the pressure difference detector 30 becomes $$h_{r1}=h(r1,\omega), \text{ and}$$

the water head increment $h_R$ caused by the rotation at a position R (the radial direction distance r=R) of the liquid outlet 4*b* of the filling flow path configuration unit 8 becomes $$h_R=h(R,\omega).$$

That is, when the rotary body 1 is rotated, while the detected pressure difference Δp detected by the pressure difference detector 30 includes a pressure increment corresponding to the water head increment $h_{r1}$ of the liquid L at the installation position r1 of the pressure difference detector 30, since a pressure increase corresponding to the water head increment $h_R$ at the position R of the liquid outlet 4*b* of the filling flow path configuration unit 8 is not included, in calculating the flow rate Q, compensation according to the revolution speed ω using the installation position r1 of the pressure difference detector 30 and the position R of the liquid outlet 4*b* as parameters is needed. In addition, while the atmospheric pressure included in the detected pressure difference Δp is measured at the installation position r1, it is assumed that the atmospheric pressure is an atmospheric pressure at the position R of the liquid outlet 4*b* of the filling flow path configuration unit 8.

Here, since the installation position r1 of the pressure difference detector 30 and the position R of the liquid outlet 4*b* are not varied because these values are determined by the structure, and characteristics of the liquid L and flow characteristics of the filling flow path configuration unit 8 are not varied when the filling liquid L and the structure of the rotary-type filling machine F1 are determined, accordingly, the flow rate Q in the rotary-type filling machine F1 can be calculated using the pressure difference Δp and the revolution speed ω as parameter as follows:

$$\text{Flow rate } Q=f(\Delta p,\omega)$$

where, f: a flow rate property function of the filling flow path configuration unit.

That is, since a relationship between the pressure difference Δp including the water head increment $h_{r1}$ at the installation position r1 of the pressure difference detector 30 and the pressure difference including the water head increment $h_R$ at the position R of the liquid outlet 4*b* of the filling flow path configuration unit 8 is determined at each revolution speed ω, when a relationship between the revolution speed ω, the pressure difference Δp, and the flow rate Q that has received an influence of the centrifugal force is previously obtained to set a flow rate property function f of the filling flow path configuration unit, the flow rate Q can be accurately obtained from the detected pressure difference Δp and the detected revolution speed ω.

In addition, since the flow characteristics of the filling flow path configuration unit 8 are considered to be slightly different from each of the filling flow path configuration units 8, it is preferable that the flow rate property function f of the filling flow path configuration unit is prepared at each of the filling flow path configuration units 8.

Using the above-mentioned results, the filling control device 20 momentarily calculates (for example, every 1 ms) the flow rate Q of each of the liquid paths 4 (the liquid outlets 4*b*) from the detected revolution speed ω detected by the revolution indicator 40, the detected pressure difference Δp detected by the pressure difference detector 30, and the flow rate property function f(Δp, ω) of the filling flow path configuration unit.

The filling control device 20 integrates and calculates the momentarily calculated flow rate (the flow rate between measurements), and closes the liquid valve 4*a* of the filling flow path configuration unit 8 when a value of the integrated and calculated result coincides with a preset target filling quantity, terminating the filling.

As described above, according to the embodiment, since the flow rate Q of the liquid L in the liquid path 4 (the liquid outlet 4*b*) of the filling flow path configuration unit 8 is obtained from the detected pressure difference Δp and the detected rotation information ω based on the previously obtained flow rate property function f(Δp, ω) of the filling flow path configuration unit, the flow rate Q is obtained in consideration of the centrifugal force generated by the rotation. Accordingly, as the filling quantity is controlled based on the flow rate Q, the liquid L can be accurately controlled.

Accordingly, since apparatuses for measuring the filling quantity such as a weight meter, a flowmeter, a timer, and so on, are not necessary, the structure can be simplified to improve maintenance characteristics or washability, and cost performance.

[Second Embodiment]

Hereinafter, a second embodiment of the present invention will be described with reference to the accompanying drawings. In addition, in the following description and the drawings used for the description, the same components as those already described are designated by the same reference numerals, and overlapping description thereof will not be repeated.

Figure 4:
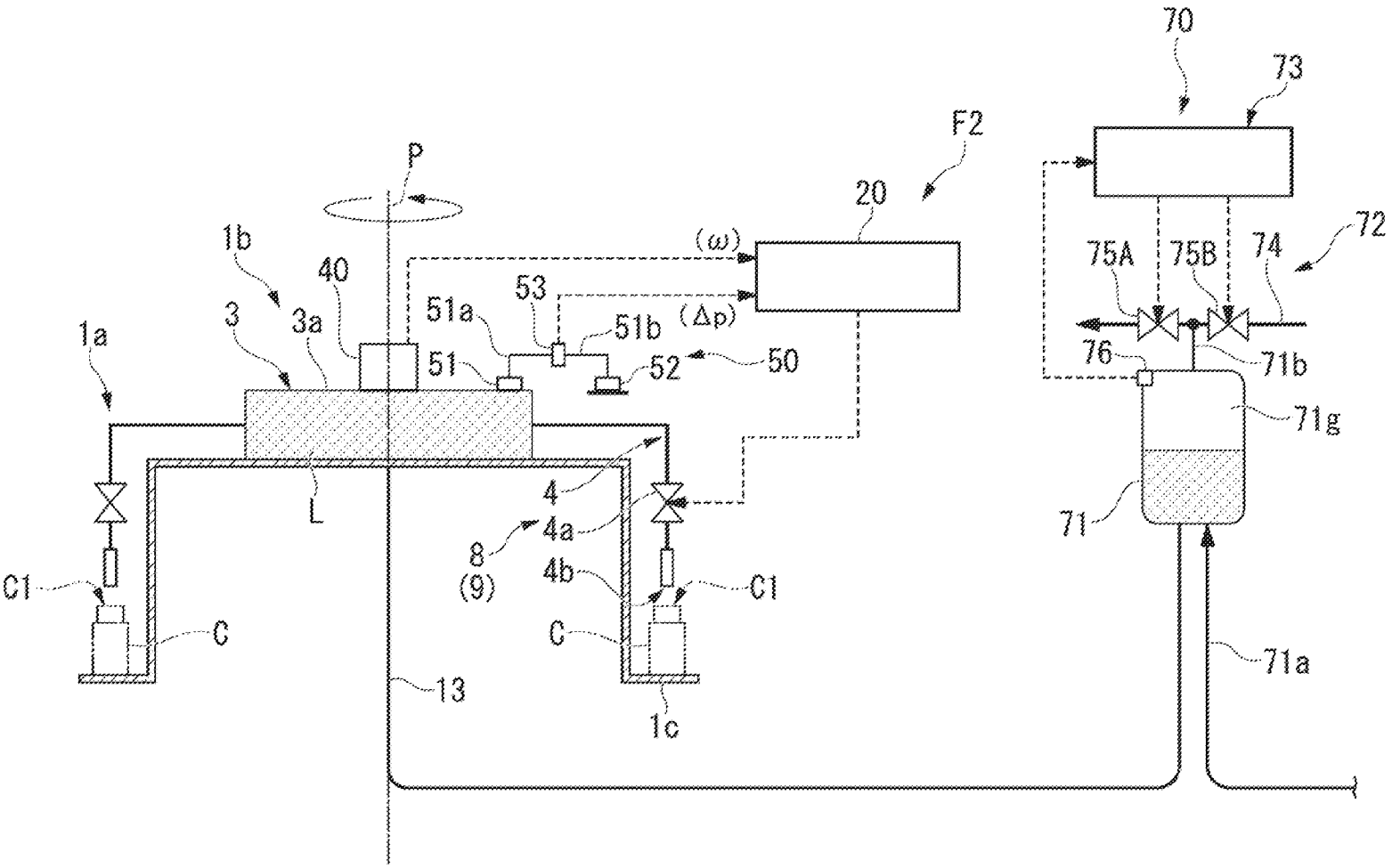
FIG. 4 is a schematic configuration view of a rotary-type filling machine F2 according to a second embodiment of the present invention.

FIG. 4 is a schematic configuration view of a rotary-type filling machine F2 according to the second embodiment of the present invention.

As shown in FIG. 4, the rotary-type filling machine F2 includes a capillary tube type pressure difference detector (a pressure difference information detection unit) 50, instead of the pressure difference detector 30 installed in the rotary-type filling machine F1 of the above-mentioned first embodiment. Like the pressure difference detector 30, the pressure difference detector 50 detects a pressure difference Δp between a liquid distribution chamber pressure, which is a pressure of the liquid L in the liquid distribution chamber 3, and an atmospheric pressure (the filling atmospheric pressure=the pressure in the container C, which is a flow release unit of the filling flow path configuration unit 8), which is the atmospheric pressure at which the liquid L is filled, and outputs the pressure difference Δp to the filling control device 20.

Figure 5:
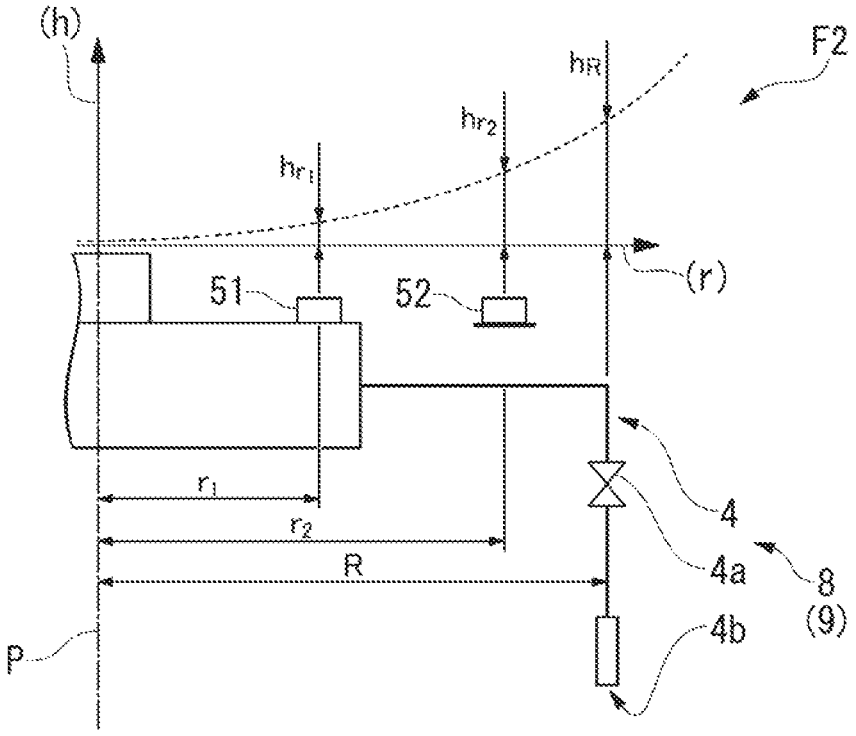
FIG. 5 is a view showing a relationship between a situation in which a water head rises due to a centrifugal force and an installation position of a pressure difference detector 50 in the rotary-type filling machine F2 according to the second embodiment of the present invention.

FIG. 5 is a view showing a relationship between a situation in which a water head rises due to the centrifugal force and an installation position of the pressure difference detector 50 in the rotary-type filling machine F2.

The pressure difference detector 50 has a first detection body 51 configured to receive a liquid distribution chamber pressure of the liquid L in the liquid distribution chamber 3, a second detection body 52 configured to receive the atmospheric pressure at a position spaced an arbitrary radial direction distance (r2−r1) from the first detection body 51, a pair of capillary tubes 51*a* and 51*b* (not shown in FIG. 5) connected to the first detection body 51 and the second detection body 52, respectively, and in which an enclosed liquid is enclosed, and a detector main body 53 configured to output a pressure difference Δp between a pressure transmitted from the first detection body 51 and a pressure transmitted from the second detection body 52 via the pair of capillary tubes 51*a* and 51*b*.

As shown in FIG. 5, the first detection body 51 is installed at the installation position r1 on the partition wall 3*a* configured to partition the liquid distribution chamber 3.

The second detection body 52 is installed at a position where the radial direction distance r is apart from the rotation central axis P with an amount of r2 (hereinafter referred to as an installation position r2) in the rotary body 1 via an attachment member (not shown).

The first detection body 51 and the second detection body 52 are set to the same height, and configured not to measure a pressure generated due to a difference in installation height. In addition, when the difference in installation height is formed, as the detection value is compensated by multiplying the height by a specific weight of the enclosed liquid, the pressure difference Δp from which an influence due to the difference in installation height is removed can be obtained.

The detector main body 53 is fixed to the rotary body 1 via an attachment member (not shown).

Like the first embodiment, even when the pressure difference detector 50 is used, the flow rate (the filling flow rate) Q of the liquid L flowing through the liquid path 4 in the non-rotation-type filling machine can be calculated from characteristics of the liquid L such as a specific weight, a liquid temperature, and so on, previously set flow characteristics of the filling flow path configuration unit 8, and a pressure difference (Δp) between a liquid inlet section and a liquid outlet section of the filling flow path configuration unit 8.

Here, since the characteristics of the liquid L and the flow characteristics of the filling flow path configuration unit 8 are not varied when the liquid L and the structure of the filling machine are determined, like the first embodiment, the flow rate Q in the non-rotation-type filling machine can be calculated using only the pressure difference Δp as a parameter as follows:

$$\text{Flow rate } Q=f'(\Delta p)$$

where, f': a flow rate property function of the filling flow path configuration unit.

As shown by the situation in which the water head rises in the rotary body 1 of FIG. 5, like the above-mentioned first embodiment, the water head increment h caused by the centrifugal force is calculated as the function h(r, ω) of the radial direction distance r and the revolution speed ω.

Accordingly, the water head increment $h_{r1}$ by the rotation of the pressure difference detector 50 at the installation position r1 is $$h_{r1}=h(r1,\omega),$$

the water head increment $h_{r2}$ by the rotation of the second detection body 52 at the installation position r2 is $$h_{r2}=h(r2,\omega), \text{ and}$$

the water head increment $h_R$ by the rotation of the liquid outlet 4*b* at the position R is $$h_R=h(R,\omega).$$

In the detected pressure difference Δp by the pressure difference detector 50, the enclosed liquid in the capillary tube 51*a* receives the centrifugal force in the outer circumferential direction of the rotary body 1 to be pulled by the water head increment $h_{r1}$ and the enclosed liquid in the capillary tube 51*b* also receives the centrifugal force in the outer circumferential direction of the rotary body 1 to be pulled by the water head increment $h_{r2}$. As a result, while a pressure higher than the detected pressure difference Δp of the first embodiment by the water head increment $h_{r2}-h_{r1}$ is detected, the detected pressure difference Δp detected by the detector main body 53 does not include a pressure increment corresponding to the water head increment $h_R$ of the liquid outlet 4*b* at the position R.

Accordingly, in calculation of the flow rate Q, compensation according to the revolution speed ω using the installation position r1 of the first detection body 51, the installation position r2 of the second detection body 52 and the position R of the liquid outlet 4*b* as parameters is needed.

Here, since the installation position r1 of the first detection body 51, the installation position r2 of the second detection body 52 and the position R of the liquid outlet 4*b* are not varied because these values are determined by the structure, and the characteristics of the liquid L and the flow characteristics of the filling flow path configuration unit 8 are not varied when the liquid L to be filled and the structure of the rotary-type filling machine F2 are determined, the flow rate Q in the rotary-type filling machine F2 using the pressure difference detector 50 can also be calculated using the pressure difference Δp and the revolution speed ω as parameters as follows:

$$\text{Flow rate } Q=f(\Delta p,\omega)$$

where, f: a flow rate property function of the filling flow path configuration unit.

That is, since a relationship between the pressure difference Δp including the water head increment $h_{r2}-h_{r1}$ at the installation position r1 and the installation position r2 and a pressure difference including the water head increment $h_R$ at the position R of the liquid outlet 4*b* is determined at every revolution speed ω, when a relationship between the pressure difference Δp and the flow rate Q that has received an influence of the centrifugal force is obtained at every revolution speed ω to set the flow rate property function f of the filling flow path configuration unit, the flow rate Q can be accurately obtained.

Using the above-mentioned results, in the filling control device 20, the flow rate Q of the liquid path 4 (the liquid outlet 4*b*) of each of the filling flow path configuration units 8 is momentarily calculated (for example, every 1 ms) from the detected revolution speed ω of the revolution indicator 40, the detected pressure difference Δp from the pressure difference detector 50 and the flow rate property function f(Δp, ω) of the filling flow path configuration unit.

The filling control device 20 integrates and calculates the flow rate Q of every moment, and closes the liquid valve 4*a* when the integrated and calculated resultant value coincides with the target filling quantity, terminating the filling.

As described above, according to the embodiment, the detection position of the pressure difference ΔP can be variously selected using the pressure difference detector 50, and the detector main body 53 requiring the attachment space can be freely disposed. Accordingly, a degree of design freedom of the rotary-type filling machine F2 can be improved.

[Third Embodiment]

Hereinafter, a third embodiment of the present invention will be described with reference to the accompanying drawings. In addition, in the following description and the drawings used for the description, the same components as those already described are designated by the same reference numerals, and overlapping description thereof will not be repeated.

Figure 6:
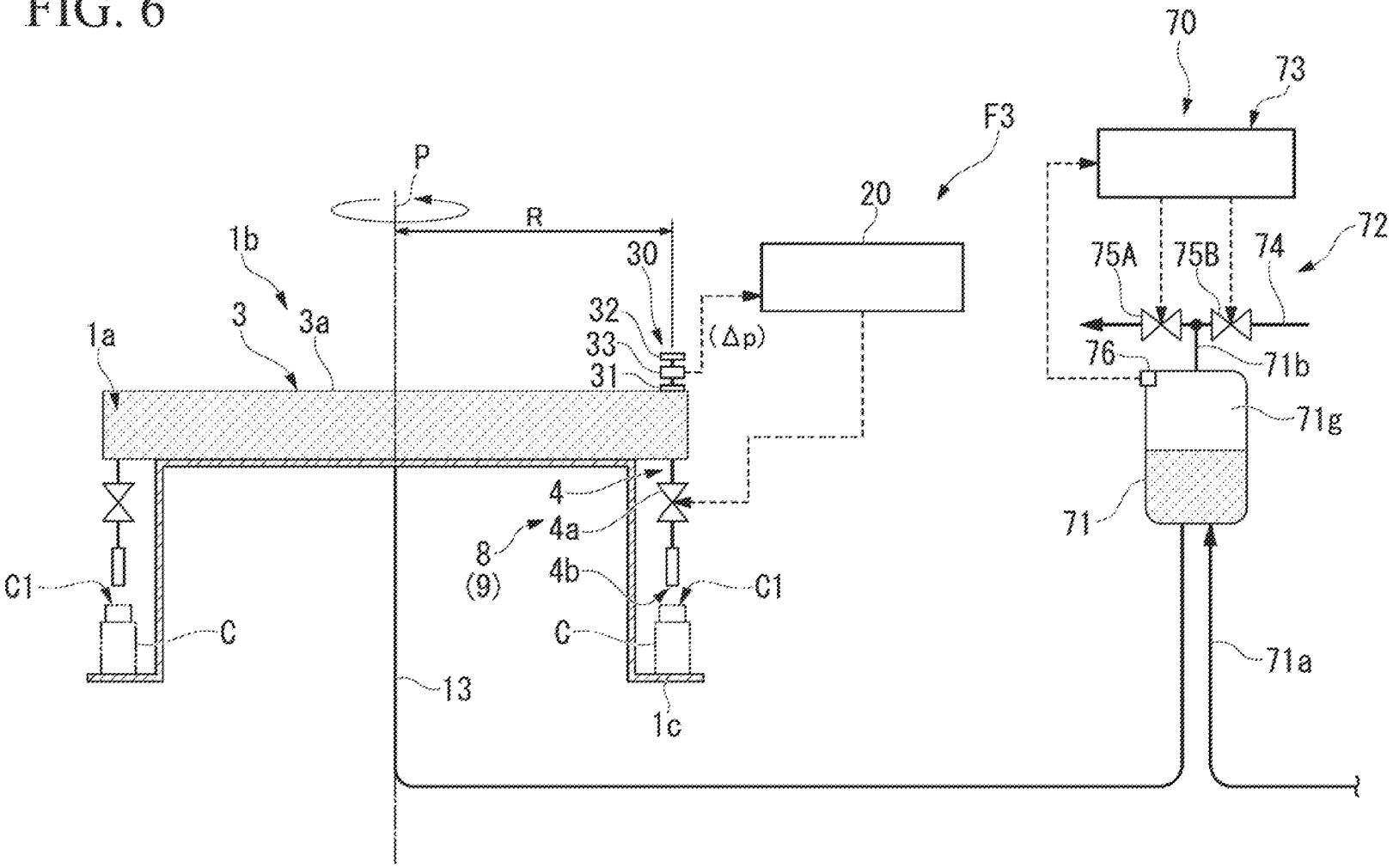
FIG. 6 is a schematic configuration view of a rotary-type filling machine F3 according to a third embodiment of the present invention.

FIG. 6 is a schematic configuration view of a rotary-type filling machine F3 according to the third embodiment of the present invention.

As shown in FIG. 6, while the rotary-type filling machine F3 has the same configuration as that of the above-mentioned first embodiment, the rotary-type filling machine F3 is distinguished from the configuration of the above-mentioned first embodiment in that the revolution indicator (the rotation information detection unit) 40 is omitted, the liquid distribution chamber 3 is enlarged in the radial direction, and the installation position of the pressure difference detector 30 is set on the liquid outlet 4*b* (the radial direction distance r=R).

The liquid distribution chamber 3 of the embodiment is configured to be enlarged above the liquid outlet 4*b*.

The filling flow path configuration unit 8 is constituted by the liquid path 4 extending downward from the outer circumferential section of the liquid distribution chamber 3 and the liquid valve 4*a*.

Figure 7:
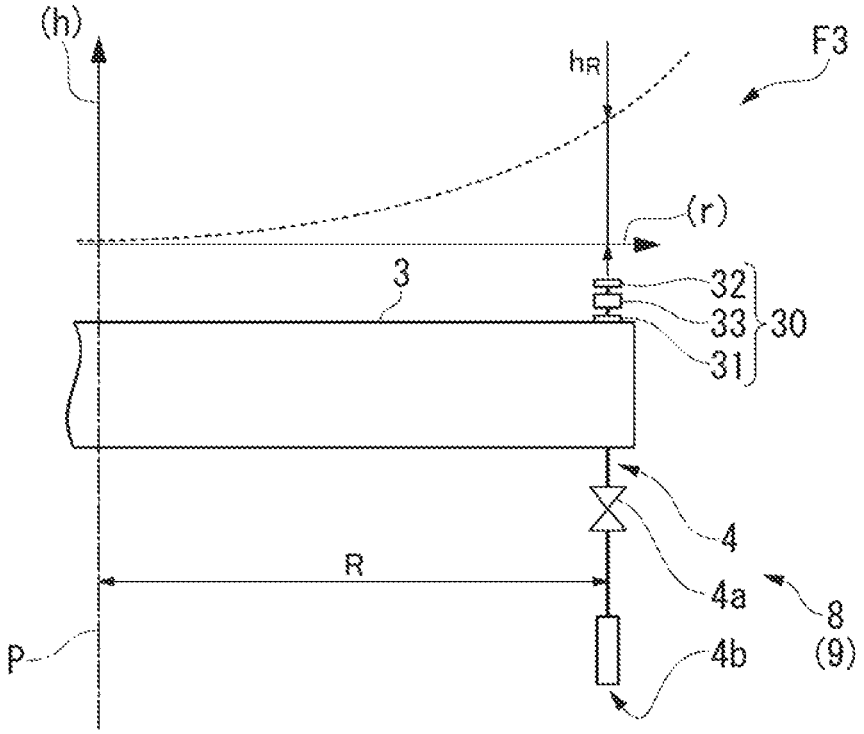
FIG. 7 is a view showing a relationship between a situation in which a water head rises due to a centrifugal force and an installation position of a pressure difference detector in the rotary-type filling machine F3 according to the third embodiment of the present invention.

FIG. 7 is a view showing a relationship between a situation in which a water head rises due to a centrifugal force and an installation position of the pressure difference detector in the rotary-type filling machine F3.

As shown in FIG. 7, an installation position R of the pressure difference detector 30 is a position spaced a radial direction distance r (=R) from the rotation central axis P in the partition wall 3*a* configured to partition the liquid distribution chamber 3, and is set such that the first detection unit 31 receives the pressure from the liquid L of the liquid distribution chamber 3 and the second detection unit 32 receives the atmospheric pressure at the installation position R. Then, the detector main body 33 outputs the pressure difference Δp obtained by subtracting the pressure at the second detection unit 32 from the pressure at the first detection unit 31 to the filling control device 20.

In the rotary-type filling machine F3, as the installation position R of the pressure difference detector 30 is set on the same circumference as the position R of the liquid outlet 4*b* related to the flow rate Q, the pressure difference detector 30 can directly detect the water head increment $h_R$ by the rotation. Then, calculation related to the revolution speed ω is not needed and the revolution indicator 40 is omitted.

Because, the installation position R of the pressure difference detector is set to be a position R of the liquid outlet 4*b*, and the water head increment of the liquid L detected by the pressure difference detector 30 is made to be equal to the water head increment $h_R=h(R, \omega)$ at the position R of the liquid outlet 4*b* related to the flow rate, an influence applied to the flow rate by the centrifugal force due to the rotation is directly detected by the pressure difference detector 30, and in calculation of the flow rate, compensation according to the revolution speed ω is not needed.

Here, since the characteristics of the liquid L and the flow characteristics of the filling flow path configuration unit 8 are not varied when the filling liquid L and the structure of the filling machine are determined, the flow rate Q in the liquid path 4 of the filling flow path configuration unit 8 in a non-rotation state can be calculated using only the pressure difference (Δp) as a parameter as follows:

$$\text{Flow rate } Q=f(\Delta p)$$

where, f: a flow rate property function of the filling flow path configuration unit.

That is, since the detected pressure difference Δp including the water head increment $h_R$ at the installation position R of the pressure difference detector 30 is detected, the flow rate Q can be accurately obtained by the flow rate property function f of the filling flow path configuration unit, which is set without consideration of the revolution speed ω.

Using the above-mentioned result, in the filling control device 20, the flow rate Q (Δp) of the liquid path 4 (the liquid outlet 4*b*) of each of the filling flow path configuration units 8 is momentarily calculated (for example, every 1 ms) from the measured value Δp from the pressure difference detector 30 and the flow rate property function f(Δp) of the filling flow path configuration unit.

The filling control device 20 integrates and calculates the momentarily calculated computation flow rate, and closes the liquid valve 4*a* when the integrated and calculated resultant value coincides with a preset target flow rate, terminating the filling.

As described above, as the installation position of the pressure difference detector 30 is set on the same circumference as the liquid outlet 4*b*, in calculation of the flow rate Q, the revolution indicator 40 can be omitted by removing the necessity of rotation information ω, and the apparatus can be more simply configured.

[Fourth Embodiment]

Hereinafter, a fourth embodiment of the present invention will be described with reference to the accompanying drawings. In addition, in the following description and the drawings used for the description, the same components as those already described are designated by the same reference numerals, and overlapping description thereof will not be repeated.

Figure 8:
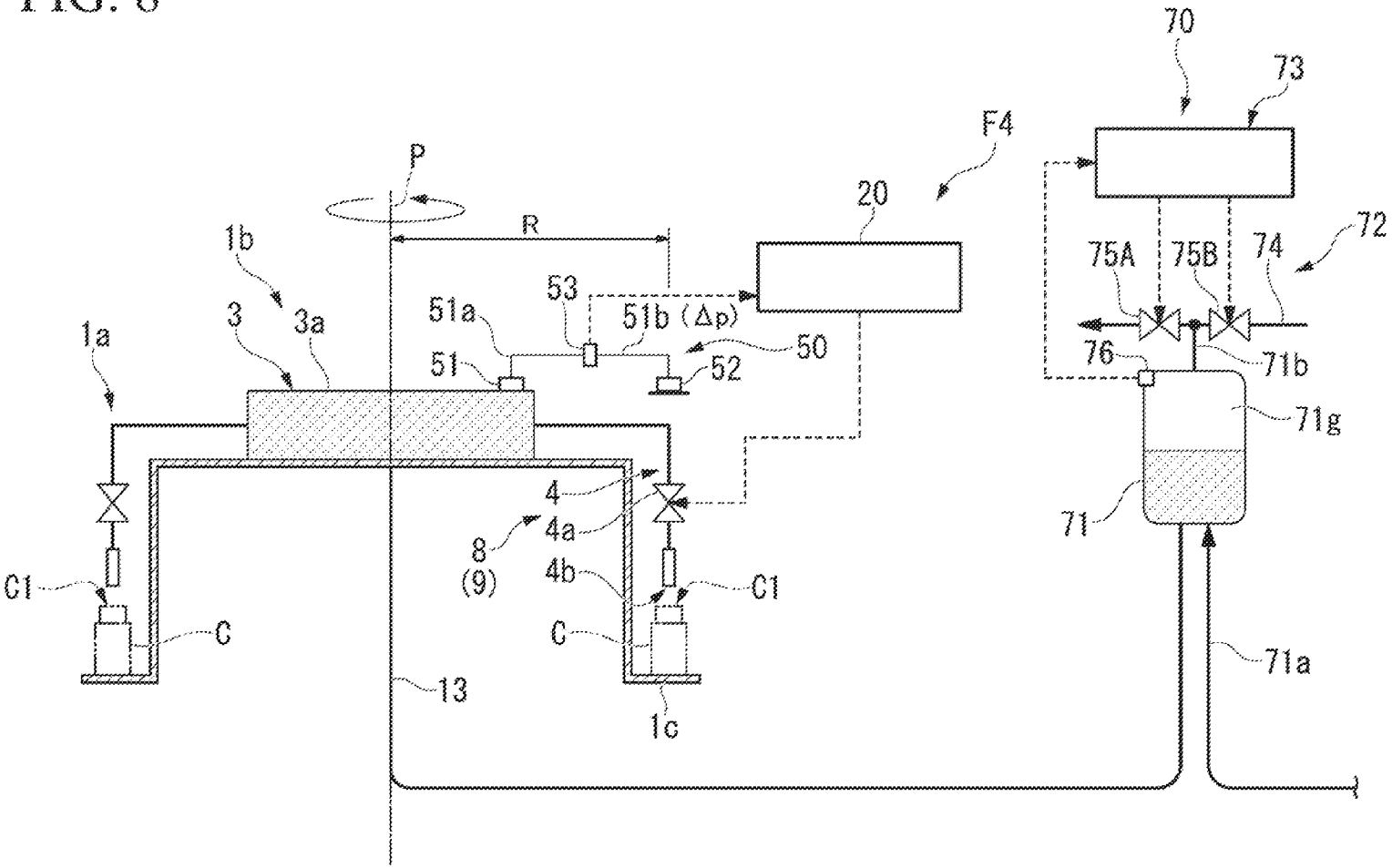
FIG. 8 is a schematic configuration view of a rotary-type filling machine F4 according to a fourth embodiment of the present invention.

FIG. 8 is a schematic configuration view of a rotary-type filling machine F4 according to the fourth embodiment of the present invention.

As shown in FIG. 8, while the rotary-type filling machine F4 has the same configuration as that of the above-mentioned second embodiment, the rotary-type filling machine F4 is distinguished from the above-mentioned second embodiment in that the revolution indicator (the rotation information detection unit) 40 is omitted, and the installation position of the pressure difference detector 50 is varied.

Figure 9:
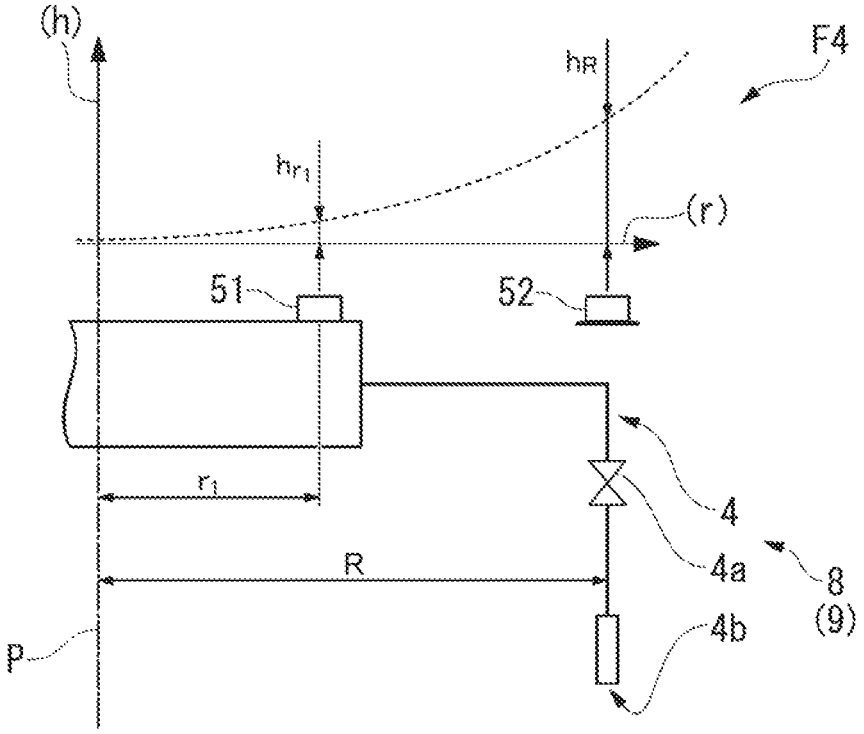
FIG. 9 is a view showing a relationship between a situation in which a water head rises due to a centrifugal force and an installation position of a pressure difference detector in the rotary-type filling machine F4 according to the fourth embodiment of the present invention.

FIG. 9 is a view showing a relationship between a situation in which a water head rises due to a centrifugal force and an installation position of a pressure difference detector in the rotary-type filling machine F4.

As shown in FIG. 9, in the rotary-type filling machine F4, the second detection body 52 is disposed in the installation position substantially the same circumference as the installation position of the liquid valve 4*a* (the installation position R), directly detects the water head increment by the rotation, and omits the revolution indicator 40 by removing the necessity of calculation related to the revolution speed w.

Like the second embodiment, in the pressure difference detected by the pressure difference detector 50, the pressure increase is detected to be higher by the water head of $h_R-h_{r1}$ in the detector main body 53 due to the enclosed liquid, in comparison with the case in which the capillary tube is not provided.

That is, when the pressure difference detector 50 is used, the pressure increment due to rotation of the rotary body 1 is a sum of a pressure increment corresponding to the water head increment $h_{r1}$ of the liquid L of the first detection body 51 and a pressure increment corresponding to the water head increment $h_R-h_{r1}$ of the enclosed liquid of the second detection body 52 from the first detection body 51, and generally, as the specific weight of the liquid L and the specific weight of the enclosed liquid are similar, the pressure increment by the resultant rotation becomes substantially a pressure increment corresponding to the water head increment $h_R$ of the enclosed liquid.

In the fourth embodiment, in consideration of a slight difference between the specific weight of the liquid L and the specific weight of the enclosed liquid, a position of the second detection body 52 is set using the radial direction distance r of the second detection body 52 substantially as the installation position R of the filling flow path configuration unit 8. Accordingly, the water head increment due to the rotation detected by the pressure difference detector 50 can be set as the water head increment $h_R$ at the position R of the liquid outlet 4*b* related to the flow rate, an influence applied to the flow rate by the rotation can be directly detected, and in calculation of the flow rate, it is not necessary to compensate according to the revolution speed ω.

Accordingly, in this case, since consideration related to the revolution speed ω is unnecessary and the characteristics of the liquid L and the flow characteristics of the filling flow path configuration unit 8 are not varied when the filling liquid L and the structure of the filling machine are determined, the flow rate Q in the rotary-type filling machine F4 can be calculated using only the pressure difference Δp as a parameter as follows:

$$\text{Flow rate } Q=f(\Delta p)$$

where, f: a flow rate property function of the filling flow path configuration unit.

Using the above-mentioned results, in the filling control device 20, the flow rate Q (Δp) of the liquid path 4 (the liquid outlet 4*b*) of each of the filling flow path configuration units 8 is momentarily calculated (for example, every 1 ms) from the measured value Δp from the pressure difference detector 50 and the flow rate property function f(Δp) of the filling flow path configuration unit.

The filling control device 20 integrates and calculates the momentarily calculated computation flow rate, and closes the liquid valve 4*a* when the integrated and calculated resultant value coincides with a preset target filling quantity, terminating the filling.

As described above, as the installation position of the second detection body 52 of the pressure difference detector 50 is set on the same circumference as the liquid outlet 4*b*, in calculation of the flow rate Q, the rotation information w is unnecessary, it is not necessary to provide the revolution indicator 40 and thus, the apparatus can be more simply configured.

In the third embodiment, as the pressure difference detector 50 is installed on the liquid distribution chamber 3 of the liquid L on the same circumference as the liquid outlet 4*b*, while the revolution indicator is unnecessary, in the case of the rotary-type filling machine (for example, a large rotary-type filling machine) in which the liquid distribution chamber 3 of the liquid L cannot be enlarged on the liquid outlet 4*b*, the configuration of the third embodiment cannot be easily provided.

For this reason, in the case of the large rotary-type filling machine, like the rotary-type filling machine F4 of the fourth embodiment, as the pressure difference detector 50 is used, since the installation position of the second detection body 52 is set on the same circumference as the liquid outlet 4*b*, the present invention can be easily applied.

[Fifth Embodiment]

Hereinafter, a fifth embodiment of the present invention will be described with reference to the accompanying drawings. In addition, in the following description and the drawings used for the description, the same components as those already described are designated by the same reference numerals, and overlapping description thereof will not be repeated.

Figure 10:
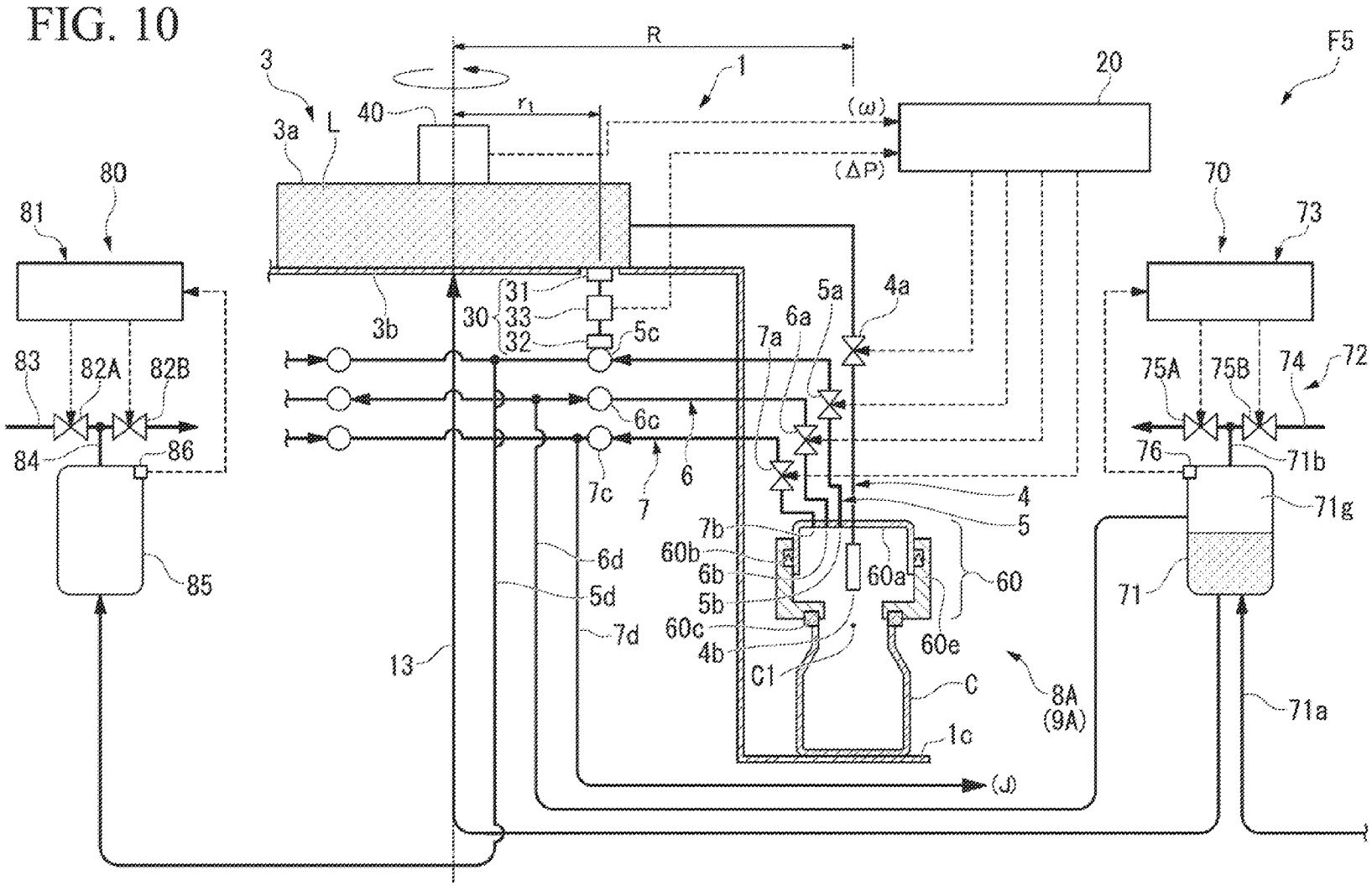
FIG. 10 is a schematic configuration view of a rotary-type filling machine F5 according to a fifth embodiment of the present invention.
Figure 11:
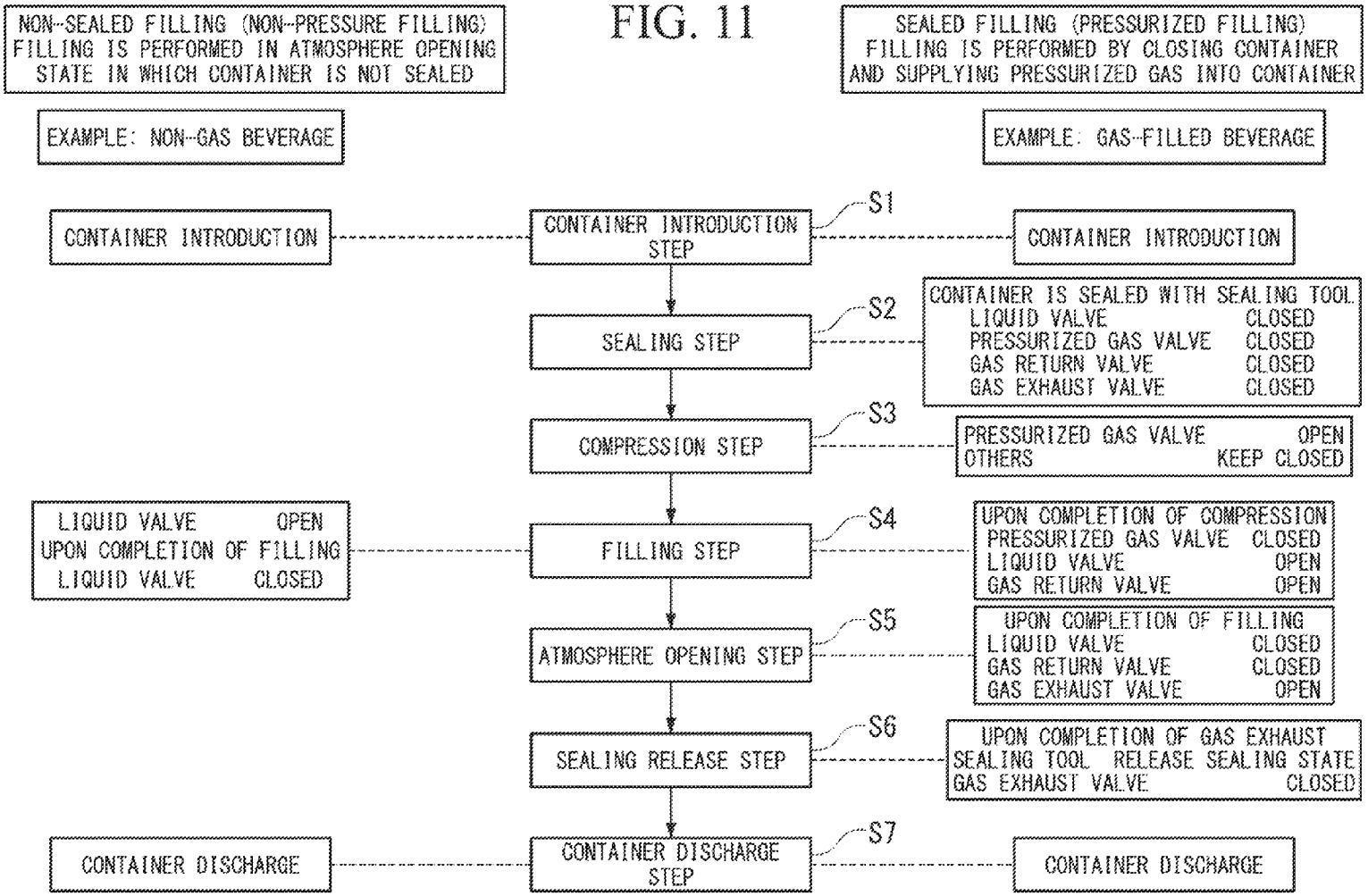
FIG. 11 is a flow chart showing operation steps of the rotary-type filling machines F1 to F8 according to the present invention.

FIG. 10 is a schematic configuration view of a rotary-type filling machine F5 according to the fifth embodiment of the present invention, and FIG. 11 shows steps of an operation in sealed filling and non-sealed filling related to the fifth embodiment of the present invention.

In the above-mentioned first to fourth embodiments (the rotary-type filling machines F1 to F4), while the present invention is applied to the rotary-type filling machine configured to fill the liquid L in a non-sealed manner, the rotary-type filling machine F5 of the embodiment is configured to fill the liquid L into the container C in a state in which the mouth section C1 of the container C is sealed, i.e., in a sealed state. In addition, the filling in the sealed state (the sealed filling) is performed, in many cases, when a gas-containing beverage including a large amount of carbon dioxide gas in the liquid L is filled into the container C.

As shown in FIG. 10, the rotary-type filling machine F5 is configured by adding known components needed to enable the filling of the liquid L to the rotary-type filling machines of the first embodiment to fourth embodiment, and specifically by adding major components including a sealing tool 60 configured to seal the filling atmosphere in the container, a pressurized gas path 6 configured to introduce a gas having a higher pressure than the atmospheric pressure (for example, $CO_2$ or an inert gas) into the container C, a return gas path 5 configured to flow a return gas therethrough during the filling of the liquid L, a discharge gas path 7 configured to discharge a gas remaining in the container C and the sealing tool 60 upon completion of the filling, and a return gas pressure control unit 80.

The sealing tool 60 is constituted by a sealing tool fixing member 60*a* having holes of the liquid outlet 4*b* of the liquid path 4, a gas inlet 5*b* of the return gas path 5, a gas outlet 6*b* of the pressurized gas path 6 and a gas inlet 7*b* of the discharge gas path 7, an elevation member 60*e* slidably fitted to the sealing tool fixing member 60*a* and elevated by a known unit (not shown), a fitting section sealing member 60*b* configured to prevent leakage of a gas from a fitting section of the sealing tool fixing member 60*a* and the elevation member 60*e*, and a container mouth sealing member 60*c* installed at the elevation member 60*e* to prevent leakage of the gas from a contact section with the mouth section C1 of the container C when the elevation member 60*e* is lowered. As the elevation member 60*e* is lowered to bring the container mouth sealing member 60*c* in contact with the mouth section of the container C in a state in which the liquid outlet 4*b* of the liquid path 4, the gas inlet 5*b* of the return gas path 5, the gas outlet 6*b* of the pressurized gas path 6 and the gas inlet 7*b* of the discharge gas path 7 are in communication with the inside of the container C, the opening section of the container C is sealed to form a closed space in the container C.

The pressurized gas path 6 is configured to introduce (supply) a gas controlled to have a pressure higher than the atmospheric pressure into the container C, and has a pressurized gas valve 6*a* disposed therein. The pressurized gas path 6 is disposed at each sealing tool 60, and joined with another pressurized gas path 6 in a pressurized gas system manifold 6*c*. The pressurized gas system manifold 6*c* is connected to an upper portion of the liquid reservoir section 71 via a pressurized pipe 6*d*, and in communication with the gaseous phase section 71*g* of the upper portion of the liquid reservoir section 71.

The return gas path 5 is configured to discharge the gas filled in the container C to the outside of the container C from the gas outlet 6*b* as a return gas as the liquid L is filled into the container C, and has a return gas valve 5*a* disposed therein. The return gas path 5 is disposed at each sealing tool 60, and joined with another return gas path 5 in a return gas system manifold (a return gas chamber) 5*c*, which is a flow release unit. The return gas system manifold 5*c* is connected to a return gas collecting section 85 of the return gas pressure control unit 80 via a return line 5*d*.

In addition, the return gas path 5, the return gas valve 5*a* and the closed space of the container C are designed such that a pressure loss of the portion when the return gas flows upon filling of the liquid L into the container becomes smaller to be negligible in comparison with the pressure loss generated due to a flow of the liquid L at the liquid path 4 and the liquid valve 4*a*.

The return gas system manifold 5*c* is formed at a position at which the radial direction distance r is spaced r1 from the rotation central axis P.

The discharge gas path 7 is configured to discharge a gas having a pressure higher than the atmospheric pressure remaining in a gap in the container C after filling of the liquid L to an atmosphere J, and has a discharge gas valve 7*a* disposed therein. The discharge gas path 7 is disposed at each sealing tool 60, and joined with another discharge gas path 7 in a discharge system manifold 7*c*. The discharge system manifold 7*c* is connected to the atmosphere J via a discharge line 7*d*.

While the above-mentioned first to fourth embodiments have the filling flow path configuration unit 8 constituted by the liquid path 4 and the liquid valve 4*a*, the embodiment has a filling flow path configuration unit 8A constituted by the liquid path 4 and the liquid valve 4*a*, the sealing tool 60, the return gas path 5 and the return gas valve 5*a*. Then, a fluid path 9A configured to separately introduce the liquid L into the container C and return a return gas to the outside from the container C is constituted by the liquid path 4 and the liquid valve 4*a*, the sealing tool 60, the return gas path 5 and the return gas valve 5*a*.

That is, while the filling flow path configuration unit 8 is applied during the non-sealed filling, the filling flow path configuration unit 8A is applied during the sealed filling.

The return gas pressure control unit 80 is constituted by the return gas collecting section 85 configured to collect the return gas during the filling, a pressure regulating valve 82A, a pressure regulating valve 82B and a pressure control device 81 configured to regulate the pressure of the return gas collecting section, an extraction steam pipe 84 configured to connect a pressure sensor 86 to the respective instruments, and a gas supply pipe 83.

The return gas collecting section 85 of the return gas pressure control unit 80 is connected to the extraction steam pipe 84 in communication with the gas supply pipe 83, and the above-mentioned return line 5*d*. In the return gas collecting section 85, the pressure of the gas is higher than the atmospheric pressure.

The pressure regulating valve 82A is connected to the gas supply pipe 83 and further the pressure regulating valve 82B is connected to the pressure regulating valve 82A to form a pair. Then, the return gas collecting section 85 is connected between the pressure regulating valve 82A and the pressure regulating valve 82B via the extraction steam pipe 84.

The pressure control device 81 controls the pair of pressure regulating valves 82A and 82B based on the pressure detected from the pressure sensor 86 installed at the return gas collecting section 85 to regulate the pressure of the gas of the return gas collecting section 85.

The pressure difference detector 30 is configured to detect a pressure difference between the inlet section and the outlet section of the filling flow path configuration unit 8A, i.e., a pressure difference Δp (pressure difference information) between a liquid distribution chamber pressure, which is a pressure of the liquid L in the liquid distribution chamber, and a return gas chamber pressure of the return gas system manifold 5*c*. As shown in FIG. 10, the pressure difference detector 30 is installed at a position where a radial direction distance r is apart from the rotation central axis P with an amount of r1 (the installation position r1) in a partition wall 3*b* configured to partition the liquid distribution chamber 3, and configured such that the first detection unit 31 receives the pressure from the liquid L of the liquid distribution chamber 3 at the installation position r1 and the second detection unit 32 receives the pressure from the gas of the return gas system manifold 5*c*. Then, the detector main body 33 outputs the pressure difference Δp obtained by subtracting the pressure at the second detection unit 32 from the pressure at the first detection unit 31 to the filling control device 20.

In addition, the inside of the liquid distribution chamber 3 is designed such that the liquid L is fully filled.

Next, an operation of the rotary-type filling machine F5 will be described with reference to the accompanying drawings.

First, as shown in FIG. 11, steps of an operation of the rotary-type filling machine F5 for filling the liquid L in the sealed state sequentially include processes of a container introduction step S1, a sealing step S2, a compression step S3, a filling step S4, an atmosphere opening step S5, a sealing release step S6, and a container discharge step S7.

First, the container C is introduced just under each of the sealing tools 60 (the container introduction step S1), and then an opening section of the container C is sealed by the sealing tool 60 to form a closed space in the container C (the sealing step S2). Here, all of the liquid valve 4*a*, the return gas valve 5*a*, the pressurized gas valve 6*a*, and the discharge gas valve 7*a* are closed.

Next, as the pressurized gas valve 6*a* of the pressurized gas path 6 is opened and the closed space of the container C is compressed by the gas, the inner space of the container C is compressed to a predetermined pressure (the compression step S3). Here, all of the liquid valve 4*a*, the return gas valve 5*a*, the pressurized gas valve 6*a*, and the discharge gas valve 7*a* are closed.

Next, after the pressurized gas valve 6*a* is closed, the liquid valve 4*a* of the liquid path 4 and the return gas valve 5*a* of the return gas path 5 are opened, and after the liquid L is filled into the container C to a predetermined amount, the filling control device 20 controls the liquid valve 4*a* to be closed (the filling step S4). The gas in the closed space of the container C is substituted with the liquid L by the filling step S4. That is, the liquid L is filled from the liquid path 4, and the gas is collected into the return gas collecting section 85 via the return gas path 5 and the return gas system manifold 5*c*. In addition, the pressure of the return gas collecting section 85 of the return gas pressure control unit 80 is set such that the pressure difference Δp between the inlet section and the outlet section of the filling flow path configuration unit configured to provide an appropriate filling flow rate Q can be obtained.

Next, as the discharge gas valve 7*a* of the discharge gas path 7 is opened after the return gas valve 5*a* of the return gas path 5 is closed, a high pressure gas remaining in the container C is released to the atmosphere J (the atmosphere opening step S5).

Next, the sealing tool 60 is detached from the opening section of the container C, the sealing of the opening section of the container C is released (the sealing release step S6), and the container C is discharged to the outside of the rotary body 1 (the container discharge step S7). Here, all of the liquid valve 4*a*, the return gas valve 5*a*, the pressurized gas valve 6*a*, and the discharge gas valve 7*a* are closed.

When the above-mentioned filling step S4 is performed in a state in which rotation of the rotary body 1 is stopped, the flow rate Q of the liquid L flowing through the liquid path 4 is calculated from flow characteristics obtained from a dimension and a shape of the flow path of the filling flow path configuration unit 8A, characteristics of the fluid flowing through the flow path of the filling flow path configuration unit 8A, i.e., characteristics of the liquid L such as a specific weight, a liquid temperature, and so on, and characteristics and a status of a gas such as a pressure, a temperature and components of a return gas, the pressure difference Δp between the inlet section and the outlet section of the filling flow path configuration unit 8A, and a pressure of the inlet section of the filling flow path configuration unit 8A by further including a flow of a gas.

Here, as described above, since a pressure loss generated by the closed space formed by the sealing tool 60 and the container C and the gas flow in the return gas path 5 and the return gas valve 5*a* is designed to be negligibly smaller than the pressure loss generated by the flow of the liquid L in the liquid path 4 and the liquid valve 4*a*, so that the gas flow is negligible, and eventually, the flow rate Q of the liquid L flowing through the liquid path 4 in a state in which rotation of the rotary body 1 is stopped can be calculated from flow characteristics obtained from a dimension and a shape of the flow path of the liquid of the filling flow path configuration unit 8A, characteristics of the liquid L such as a specific weight, a liquid temperature, and so on, and the pressure difference Δp between the inlet section and the outlet section of the filling flow path configuration unit 8A.

Accordingly, since the characteristics of the liquid L and the flow characteristics of the filling flow path configuration unit 8A (the fluid path 9A) are not varied when the filling liquid L and the structure of the filling machine are determined, the flow rate Q in the liquid path 4 in the non-rotation state can be calculated using only the pressure difference (Δp) as a parameter as follows:

$$\text{Flow rate } Q=f'(\Delta p)$$

where, f': a flow rate property function of the filling flow path configuration unit.

Meanwhile, when the rotary body 1 is rotated in the above-mentioned filling step S4, the water head increment h caused by the rotation is added, and the actual flow rate Q is increased in comparison with the flow rate Q obtained from the flow rate property function f' of the filling flow path configuration unit.

The water head increment h caused by the rotation is increased according to an increase in distance from the rotation central axis P of the rotary body 1 with respect to the rotation central axis P of the rotary body 1, and increased according to an increase in revolution speed ω (see FIG. 3).

When these are expressed in an equation, the water head increment h caused by the rotation is calculated as the function h(r, ω) of the radial direction distance r and the revolution speed ω.

Accordingly, the water head increment $h_{r1}$ caused by the rotation at the installation position r1 of the pressure difference detector 30 is $$h_{r1}=h(r1,\omega), \text{ and}$$

the water head increment $h_R$ caused by the rotation at the position R of the liquid outlet 4*b* is $$h_R=h(R,\omega).$$

That is, when the rotary body 1 is rotated, while the detected pressure difference Δp by the pressure difference detector 30 includes a pressure increment corresponding to the water head increment $h_{r1}$ of the liquid L at the installation position r1 of the pressure difference detector 30, since the pressure increase corresponding to the water head increment $h_R$ at the position R of the liquid outlet 4*b* related to the flow rate is not included, in calculation of the flow rate Q, compensation according to the revolution speed ω using the installation position r1 of the pressure difference detector 30 and the position R of the liquid outlet 4*b* as parameters is needed.

Here, since the installation position r1 of the pressure difference detector 30 and the position R of the liquid outlet 4*b* are not varied because these values are determined by the structure, and the characteristics of the liquid L and the flow characteristics of the filling flow path configuration unit 8A are not varied when the filling liquid L and the structure of the filling machine are determined, the flow rate Q in the rotary-type filling machine F5 can be calculated using the detected pressure difference Δp and the revolution speed ω as parameters as follows:

$$\text{Flow rate } Q=f(\Delta p,\omega)$$

where, f: a flow rate property function of the filling flow path configuration unit.

In addition, since the filling flow path configuration units 8A are considered to have slightly different flow characteristics from each other, the flow rate property function f of the filling flow path configuration unit may be prepared for each of the filling flow path configuration units 8A.

Using the above-mentioned results, the filling control device 20 momentarily calculates (for example, every 1 ms) the flow rate Q(Δp, ω) of the liquid path 4 (the liquid outlet 4*b*) of each of the filling flow path configuration units 8A from the revolution speed ω of the revolution indicator 40, the detected pressure difference Δp from the pressure difference detector 30, and the flow rate property function f(Δp, ω) of the filling flow path configuration unit.

The filling control device 20 integrates and calculates the momentarily calculated flow rate (the flow rate between measurements), and closes the liquid valve 4*a* when the integrated and calculated resultant value coincides with a preset target filling quantity, terminating the filling.

As described above, according to the embodiment, the pressure difference Δp can be obtained from the pressure of the gas in the return gas system manifold 5*c* of the return gas path 5 and the pressure of the liquid L of the liquid distribution chamber 3. Accordingly, based on the previously obtained flow rate property function f(Δp, ω) of the filling flow path configuration unit, the flow rate Q of the liquid L receiving the centrifugal force caused by the rotation in the liquid path 4 (the liquid outlet 4*b*) of the filling flow path configuration unit 8A can be obtained from the detected pressure difference Δp and the detected rotation information ω. Accordingly, as the filling quantity is controlled based on the flow rate Q, the liquid L can be accurately controlled.

In addition, since the measurement apparatuses of the filling quantity such as a weight meter, a flowmeter, a timer, and so on, are unnecessary, maintenance characteristics or washability and cost characteristics can be improved with a simple structure.

[Sixth Embodiment]

Hereinafter, a sixth embodiment of the present invention will be described with reference to the accompanying drawings. In addition, in the following description and the drawings used for the description, the same components as those already described are designated by the same reference numerals, and overlapping description thereof will not be repeated.

Figure 12:
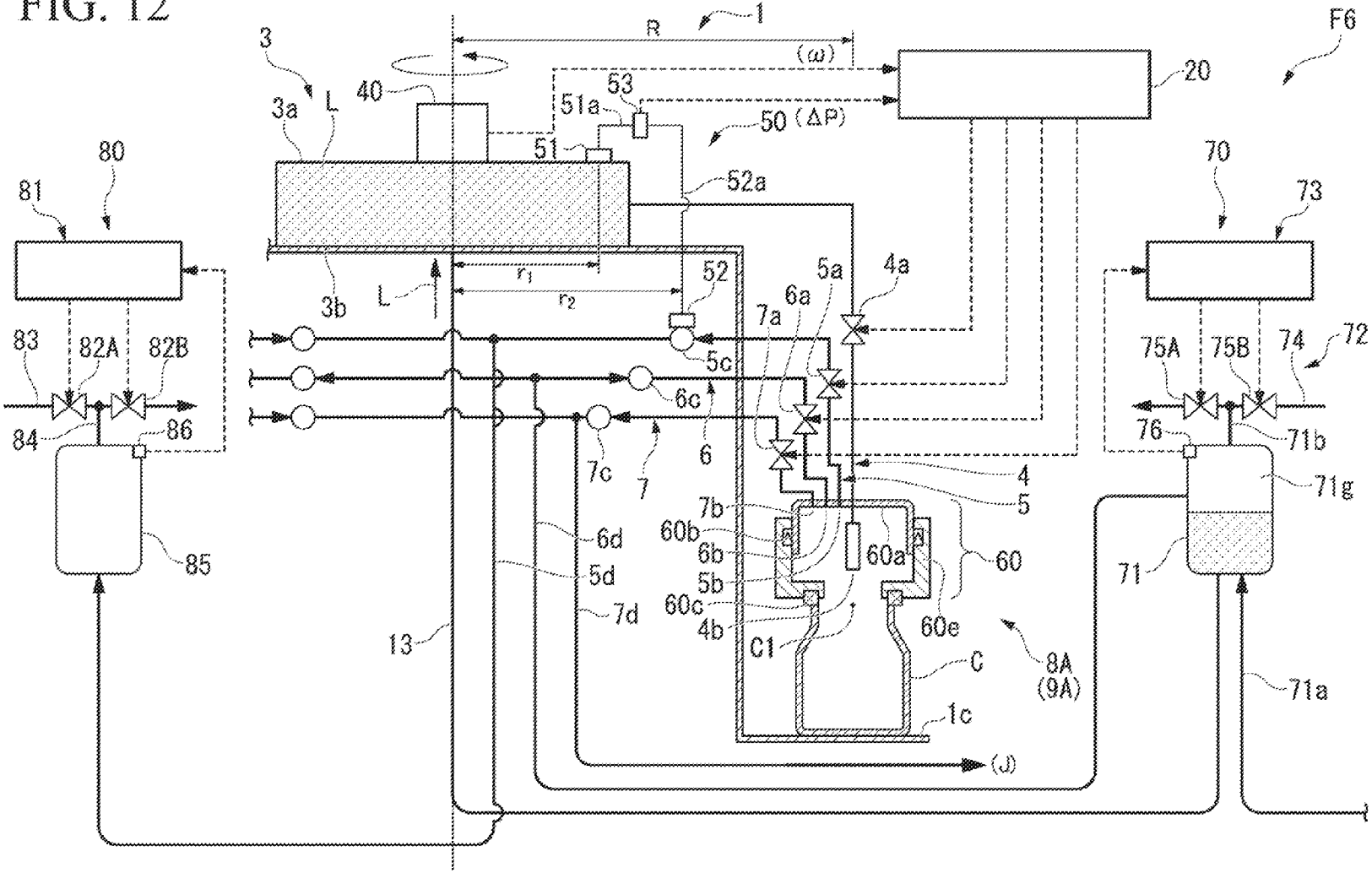
FIG. 12 is a schematic configuration view of a rotary-type filling machine F6 according to a sixth embodiment of the present invention.

FIG. 12 is a schematic configuration view of a rotary-type filling machine F6 according to the sixth embodiment of the present invention.

As shown in FIG. 12, the rotary-type filling machine F6 includes the pressure difference detector 50 instead of the pressure difference detector 30 included in the above-mentioned fifth embodiment.

As shown in FIG. 12, the first detection body 51 is installed at a position where the radial direction distance r is apart from the rotation central axis P with an amount of r1 at the partition wall 3*a* configured to partition the liquid distribution chamber 3, and set to receive the pressure from the liquid L of the liquid distribution chamber 3.

The second detection body 52 is installed at a position where the radial direction distance r is apart from the rotation central axis P with an amount of r2 at the return gas system manifold 5*c* of the return gas path 5 of the rotary body 1, and set to receive the pressure from the gas.

Since the characteristics of the liquid L and the flow characteristics of the filling flow path configuration unit 8A are not varied when the liquid L to be filled and the structure of the filling machine are determined, in the filling step S4, the flow rate Q when the filling is performed in a state in which rotation of the rotary body 1 is stopped can be calculated using only the pressure difference Δp as a parameter as follows:

$$\text{Flow rate } Q=f'(\Delta p)$$

where, f': a flow rate property function of the filling flow path configuration unit.

Like the above-mentioned second embodiment, the water head increment h caused by the centrifugal force is calculated as the function h(r, ω) of the radial direction distance r and the revolution speed ω (see FIG. 5).

Accordingly, the water head increment $h_{r1}$ by the rotation at the installation position r1 of the first detection body 51 of the pressure difference detector 50 is $$h_{r1}=h(r1,\omega),$$

the water head increment $h_{r2}$ by the rotation at the installation position r2 of the second detection body 52 is $$h_{r2}=h(r2,\omega), \text{ and}$$

the water head increment $h_R$ by the rotation at the position R of the liquid outlet 4*b* is $$h_R=h(R,\omega).$$

In the detected pressure difference by the pressure difference detector, the enclosed liquid in the capillary tube 51*a* receives the centrifugal force in the outer circumferential direction of the rotary body to be pulled by the water head increment $h_{r1}$, and the enclosed liquid in the capillary tube 51*b* also receives the centrifugal force in the outer circumferential direction of the rotary body 1 to be pulled by the water head increment $h_{r2}$. As a result, while the pressure higher than the detected pressure difference Δp by the water head increment $h_{r2}-h_{r1}$ in the fifth embodiment is detected in the detected pressure difference Δp detected by the detector main body 53, a pressure increment corresponding to the water head increment $h_R$ at the position R of the liquid outlet 4*b* related to the flow rate Q is not included therein.

Accordingly, in calculation of the flow rate, compensation according to the revolution speed ω using the installation position r1 of the first detection body 51, the installation position r2 of the second detection body 52 and the position R of the liquid outlet 4*b* as parameters is needed.

Here, since the installation position r1 of the first detection body 51, the installation position r2 of the second detection body 52 and the position R of the liquid outlet 4*b* are not varied because these values are determined by the structure and the characteristics of the liquid L and the flow characteristics of the filling flow path configuration unit 8A are not varied when the liquid L to be filled and the structure of the filling machine are determined, the flow rate Q in the rotary-type filling machine F5 that has used the pressure difference detector 50 can also be calculated using the pressure difference Δp and the revolution speed ω as parameters as follows:

$$\text{Flow rate } Q=f(\Delta p,\omega)$$

where, f: a flow rate property function of the filling flow path configuration unit.

That is, since a relationship between the detected pressure difference Δp including the water head increment $h_{r2}-h_{r1}$ at the installation position r1 and the installation position r2 and the pressure difference including the water head increment $h_R$ at the position R of the liquid outlet 4*b* at every revolution speed ω is determined, when a relationship between the pressure difference Δp and the flow rate Q that has received an influence of the centrifugal force is previously obtained at every revolution speed ω to set the flow rate property function f of the filling flow path configuration unit, the flow rate Q can be accurately obtained.

Using the above-mentioned results, in the filling control device 20, the flow rate Q(Δp, ω) of the liquid path 4 (the liquid outlet 4*b*) of each of the filling flow path configuration units 8A is momentarily calculated (for example, every 1 ms) from the revolution speed ω of the revolution indicator 40, a measured value Δp from the pressure difference detector 50, and the flow rate property function f(Δp, ω) of the filling flow path configuration unit.

The filling control device 20 integrates and calculates the momentarily calculated computation flow rate, and closes the liquid valve 4*a* when the integrated and calculated resultant value coincides with a preset target filling quantity, terminating the filling.

As described above, according to the embodiment, as the pressure difference detector 50 is used, since the return gas chamber pressure of the return gas system manifold 5*c* of the return gas path 5 can be easily detected and the detector main body 53 requiring the attachment space can be freely disposed, a degree of design freedom of the rotary-type filling machine F5 can be improved.

Figure 13:
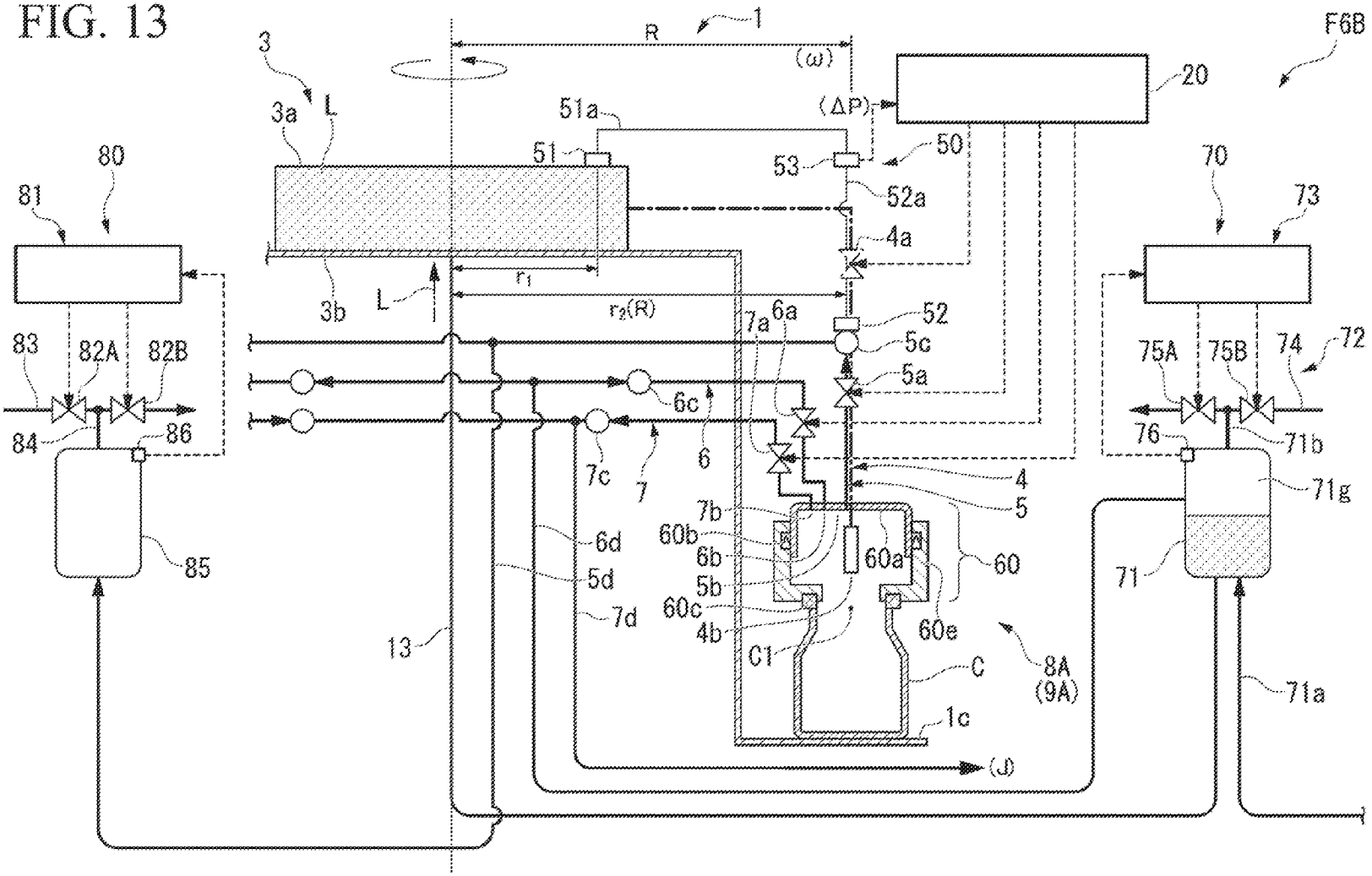
FIG. 13 is a schematic configuration view of a rotary-type filling machine F6B, which is a modified example of the rotary-type filling machine F6 according to the sixth embodiment of the present invention.

FIG. 13 is a schematic configuration view of F6B, which is a modified example of the rotary-type filling machine F6 according to the sixth embodiment of the present invention.

The rotary-type filling machine F6B is distinguished from the rotary-type filling machine F6 in that the return gas system manifold 5*c* of the return gas path 5 in the above-mentioned sixth embodiment is disposed at substantially the same radial direction position (R) as the liquid path 4, the second detection body 52 is also disposed at substantially the same radial direction position (R) as the liquid path 4 of the return gas system manifold 5*c*, and the revolution indicator (the rotation information detection unit) 40 is unnecessary. In addition, in FIG. 13, for the convenience of understanding, the liquid path 4 and the liquid valve 4*a* are shown by dot-dash lines.

As shown in FIG. 13, the first detection body 51 is disposed at a position where the radial direction distance r is apart from the rotation central axis P with an amount of r1 at the partition wall 3*a* configured to partition the liquid distribution chamber 3, and set to receive the pressure from the liquid L of the liquid distribution chamber 3.

The second detection body 52 is disposed at a position where the radial direction distance r is apart from the rotation central axis P with an amount of R at the return gas system manifold 5*c* of the return gas path 5 of the rotary body 1, and set to receive the pressure from the gas.

Since the characteristics of the liquid L and the flow characteristics of the filling flow path configuration unit 8A are not varied when the liquid L to be filled and the structure of the filling machine are determined, in the filling step S4, the flow rate Q when the filling is performed in a state in which rotation of the rotary body 1 is stopped can be calculated using only the pressure difference Δp as a parameter as follows:

$$\text{Flow rate } Q=f'(\Delta p)$$

where, f': a flow rate property function of the filling flow path configuration unit.

Like the above-mentioned fourth embodiment, the water head increment h caused by the centrifugal force is calculated as the function h(r, ω) of the radial direction distance r and the revolution speed ω (see FIG. 9).

Accordingly, the water head increment $h_{r1}$ by the rotation at the installation position r1 of the first detection body 51 of the pressure difference detector 50 is $$h_{r1}=h(r1,\omega),$$

the water head increment $h_R$ by the rotation at the installation position R of the second detection body 52 is $$h_R=h(R,\omega), \text{ and}$$

the water head increment $h_R$ by the rotation at the position R of the liquid outlet 4*b* is $$h_R=h(R,\omega).$$

That is, like the fourth embodiment, as the installation position of the second detection body 52 is disposed at substantially the same radial direction position (R) as the liquid path 4, the rotation information is not needed.

As described above, according to the embodiment, as the installation position of the second detection body 52 is disposed at substantially the same radial direction position (R) as the liquid path 4, the rotation information is not needed and the apparatus can be more simply configured.

Figure 14:
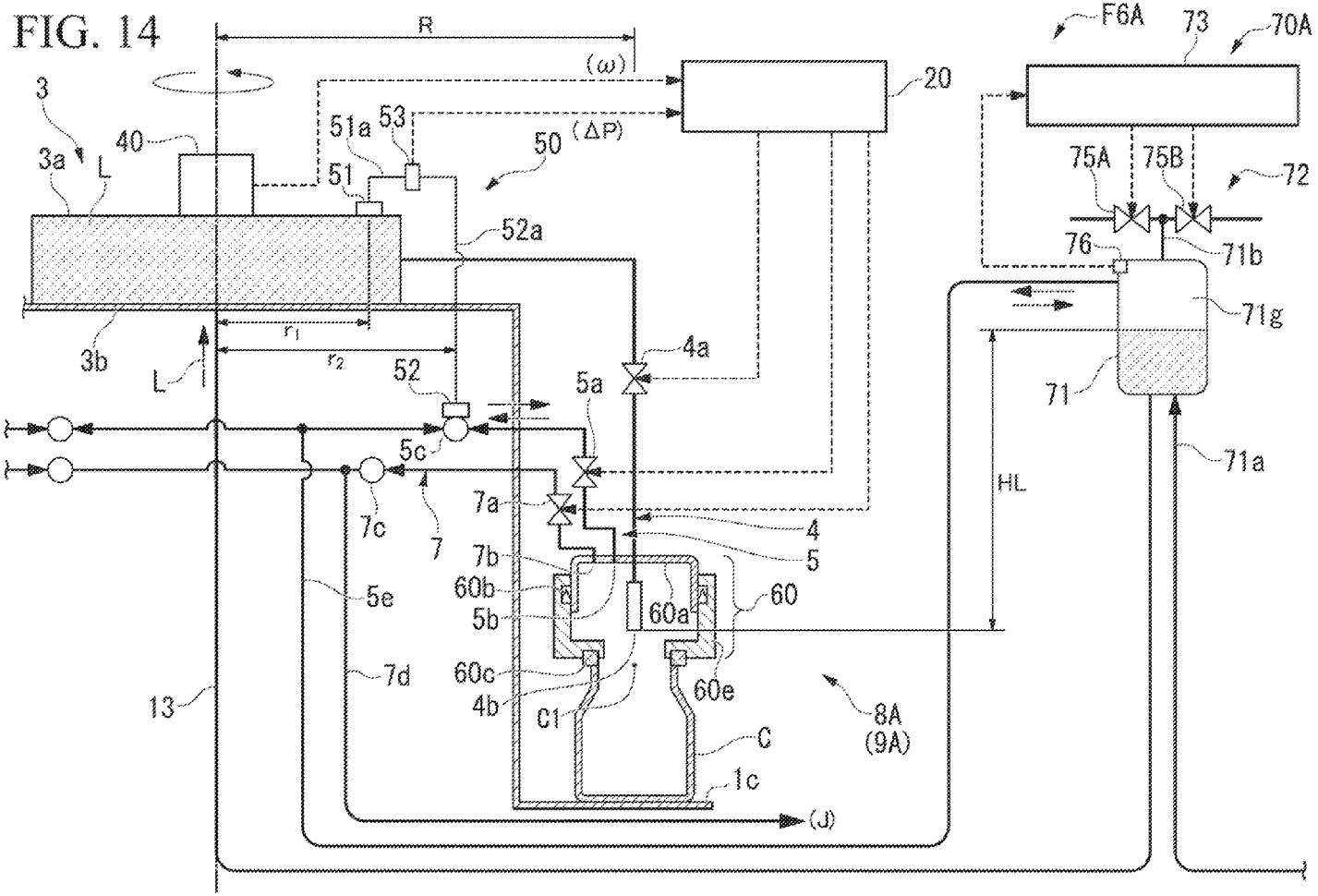
FIG. 14 is a schematic configuration view of a rotary-type filling machine F6A, which is a modified example of the rotary-type filling machine F6 according to the sixth embodiment of the present invention.

FIG. 14 is a view of the rotary-type filling machine F6A, which is a modified example of the rotary-type filling machine F6.

The rotary-type filling machine F6A is distinguished from the rotary-type filling machine F6 of the above-mentioned fifth embodiment in that the pressurized gas path 6, the pressurized gas valve 6*a*, the pressurized gas system manifold 6*c*, the pressurized pipe 6*d*, the return gas pressure control unit 80 and the return line 5*d* are omitted, and a return line 5*e* configured to connect an upper portion of the liquid reservoir section 71 and the return gas system manifold 5*c* is added.

The rotary-type filling machine F6A is configured to supply the gas configured to compress the closed space of the container C from the gaseous phase section 71*g* of the liquid supply unit 70 and collect the return gas during the filling from the closed space of the container C into the gaseous phase section 71*g* of the same liquid supply unit 70 by connecting the return gas system manifold 5*c*, with which the return gas path 5 of the filling flow path configuration unit 8A is joined, to an upper portion of the liquid reservoir section 71, instead of the return gas collecting section 85 of the return gas pressure control unit 80. In the case of the embodiment, as the pressurized gas path 6 and the return gas path 5 are shared, the structure of the rotary-type filling machine F6 can be more simplified.

In addition, the liquid reservoir section 71 of the liquid supply unit 70 is installed such that the liquid surface of the liquid L in the liquid reservoir section 71 is disposed at a higher position than the liquid outlet 4*b* of the liquid path 4 of the filling flow path configuration unit 8A by a water head difference HL. A dimension and a shape of the flow path of the liquid of the filling flow path configuration unit 8A are designed such that the required filling flow rate Q can be obtained by the pressure difference Δp before and after the filling flow path configuration unit 8A obtained based on the water head difference HL.

In this configuration, in the above-mentioned filling step S4, while maintaining a state in which the return gas path 5 of the filling flow path configuration unit 8A is opened, the liquid valve 4*a* of the liquid path 4 of the filling flow path configuration unit 8A is opened. In this way, the liquid L is filled from the liquid path 4 of the filling flow path configuration unit 8A, and the return gas is collected into the gaseous phase section 71*g* of the liquid supply unit 70 via the return gas path 5 of the filling flow path configuration unit 8A.

Then, the pressure of the return gas during the filling is detected at the return gas system manifold 5*c*, and the pressure difference Δp is detected using the pressure as the filling atmospheric pressure.

According to the modified example, the apparatus can be more simply configured. For example, even in the rotary-type filling machine F5 of the above-mentioned fifth embodiment, as the liquid reservoir section 71 of the liquid supply unit 70 is installed such that the liquid surface of the liquid L in the liquid reservoir section 71 is disposed at a position higher than the liquid outlet 4*b* of the liquid path 4 of the filling flow path configuration unit 8A by the water head difference HL, and the dimension and the shape of the flow path of the liquid of the filling flow path configuration unit 8A are designed such that the required filling flow rate Q can be obtained by the pressure difference Δp before and after the filling flow path configuration unit 8A obtained based on the water head difference HL, the apparatus can be configured simply.

[Seventh Embodiment]

Hereinafter, a seventh embodiment of the present invention will be described with reference to the accompanying drawings. In addition, in the following description and the drawings used for the description, the same components as those already described are designated by the same reference numerals, and overlapping description thereof will not be repeated.

Figure 15:
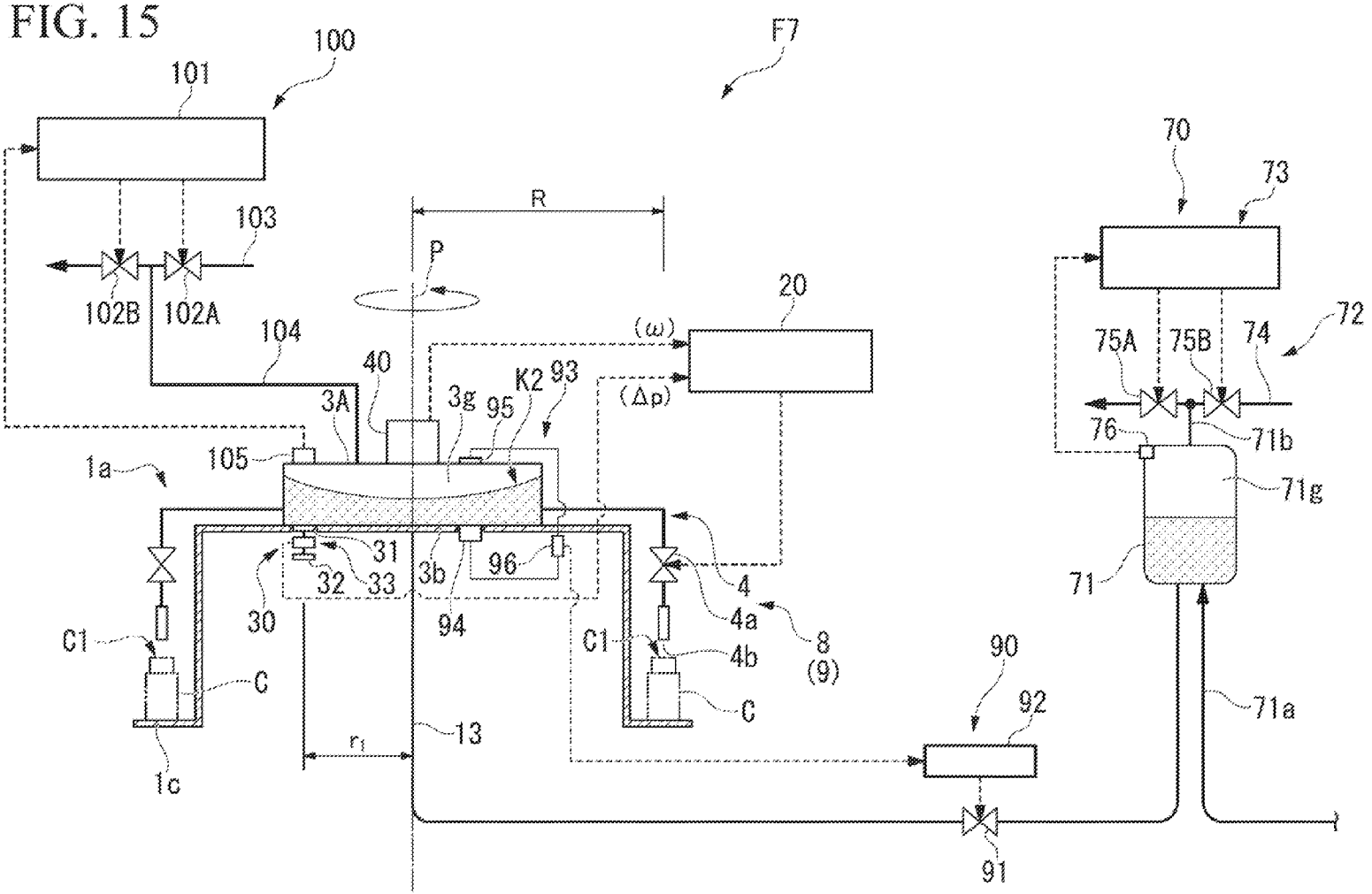
FIG. 15 is a schematic configuration view of a rotary-type filling machine F7 according to a seventh embodiment of the present invention.

FIG. 15 is a schematic configuration view of a rotary-type filling machine F7 according to the seventh embodiment of the present invention.

In the rotary-type filling machine F1 according to the above-mentioned first embodiment, the inside of the liquid distribution chamber 3 is fully filled in the liquid phase of the liquid L only, and the pressure difference detector 30 is disposed at the partition wall 3*a* of the liquid distribution chamber 3. On the other hand, in the rotary-type filling machine F7 of the embodiment, the inside of the liquid distribution chamber 3A is constituted by a liquid phase of the liquid L and a gaseous phase section 3*g* such as air, nitrogen gas, and so on, and the pressure difference detector 30 is disposed at the partition wall 3*b* of the liquid distribution chamber 3A. Further, the rotary-type filling machine F7 includes a liquid distribution chamber gas pressure control unit 100 configured to regulate a pressure of the gaseous phase section 3*g* of the liquid distribution chamber 3 and a liquid distribution chamber liquid level control unit 90 configured to control a liquid level of the liquid L of the liquid distribution chamber 3A.

The pressure difference detector 30 is installed at a position where a radial direction distance r is apart from the rotation central axis P with an amount of r1 (an installation position r1) at the partition wall 3*b* configured to partition the liquid distribution chamber 3A, and configured such that the first detection unit 31 receives the pressure from the liquid L of the liquid distribution chamber 3A and the second detection unit 32 receives the pressure from the atmosphere J at the installation position r1.

The liquid distribution chamber gas pressure control unit 100 includes a pressure control device 101, a gas circulation pipe 103 through which a gas supplied into the gaseous phase section 3*g* of the liquid distribution chamber 3A flows, a pair of pressure regulating valves 102A and 102B installed at the gas circulation pipe 103, an introduction pipe 104 configured to connect the gas circulation pipe 103 between the pair of pressure regulating valves 102A and 102B to the liquid distribution chamber 3A, and a pressure sensor 105 installed at the partition wall 3*a* of the liquid distribution chamber 3A and configured to detect the pressure of the gaseous phase section 3*g* of the liquid distribution chamber 3A.

The pressure control device 101 controls the pair of pressure regulating valves 102A and 102B based on a detection value of the pressure of the gaseous phase section 3*g* of the liquid distribution chamber 3A detected by the pressure sensor 105, and controls the pressure of the gaseous phase section 3*g* of the liquid distribution chamber 3A to a set value.

The liquid distribution chamber liquid level control unit 90 includes a liquid level control device 92 configured to control a flow rate control valve 91 that controls a flow rate of the liquid L conveyed to the liquid distribution chamber 3A and flowing through the liquid feed line 13, and a pressure difference type liquid level gauge 93 configured to output a pressure difference signal that indicates a liquid level of the liquid L in the liquid distribution chamber 3A to the liquid level control device 92.

Like the pressure difference detector 50, in the pressure difference type liquid level gauge 93, a first detection body 94 is installed at the partition wall 3*b* and configured to receive the pressure from the liquid L of the liquid distribution chamber 3A, and a second detection body 95 is installed at the partition wall 3*a* and configured to receive the pressure of the gaseous phase section 3*g* of the liquid distribution chamber 3A. Then, a detector main body 96 outputs the pressure difference obtained by subtracting the pressure at the second detection body 95 from the pressure at the first detection body 94 to the liquid level control device 92.

The radial direction distances r of the first detection body 94 and the second detection body 95 are disposed at positions corresponding to about half an inner radius of the liquid distribution chamber 3A, and the liquid level, which is a control reference, is set such that the liquid level upon stoppage of the rotary body 1 is substantially the same as the liquid level upon rotation thereof.

The liquid level control device 92 controls the flow rate control valve 91 to adjust a flow rate of the liquid L conveyed from the liquid feed line 13 to the liquid distribution chamber 3A when the pressure difference input from the pressure difference type liquid level gauge 93 is varied from a reference pressure difference corresponding to a reference liquid level, controlling the liquid level in the liquid distribution chamber 3A to be held in a necessary condition.

Next, an operation of the above-mentioned rotary-type filling machine F7 will be described.

As shown in FIG. 3, when the rotary body 1 is rotated in the rotary-type filling machine F7, the flow rate Q is increased due to a water head rise caused by the centrifugal force. Here, the liquid surface in the liquid distribution chamber 3A has a mortar-shaped curved surface, and as shown in FIG. 15, a curved line K2 of the liquid surface having a cross-section including the rotation central axis P of the rotary body 1 has the same curved line as a water head rise curved line K1 caused by the centrifugal force shown in FIG. 3.

Expressing these in equations, the water head increment h caused by the rotation is calculated as the function h(r, ω) of the radial direction distance r and the revolution speed ω. Accordingly, the water head increment $h_{r1}$ by the rotation at the installation position r1 of the pressure difference detector 30 is $$h_{r1}=h(r1,\omega), \text{ and}$$

the water head increment $h_R$ by the rotation at the position R of the liquid outlet 4*b* is $$h_R=h(R,\omega).$$

That is, when the rotary body 1 is rotated, while the detected pressure difference Δp by the pressure difference detector 30 includes a pressure increment corresponding to the water head increment $h_{r1}$ of the liquid L at the installation position r1 of the pressure difference detector 30, since a pressure increase corresponding to the water head increment $h_R$ at the position R of the liquid outlet 4*b* of the filling flow path configuration unit 8 related to the flow rate is not included, in calculation of the flow rate Q, compensation corresponding to the revolution speed ω using the installation position r1 of the pressure difference detector 30 and the position R of the liquid outlet 4*b* of the filling flow path configuration unit 8 as parameters is needed.

Here, since the installation position r1 of the pressure difference detector 30 and the position R of the liquid outlet 4*b* are not varied because these values are determined by the structure thereof and the characteristics of the liquid L and the flow characteristics of the filling flow path configuration unit 8 are not varied when the liquid L to be filled and the structure of the filling machine is determined, the flow rate Q in the rotary-type filling machine F7 can be calculated using the detected pressure difference Δp and the revolution speed ω as parameters as follows:

$$\text{Flow rate } Q=f(\Delta p,\omega)$$

where, f: a flow rate property function of the filling flow path configuration unit.

That is, since a relationship between the detected pressure difference Δp including the water head increment $h_{r1}$ at the installation position r1 of the pressure difference detector 30 and the pressure difference including the water head increment $h_R$ at the position R of the liquid outlet 4*b* of the filling flow path configuration unit 8 is determined at every revolution speed ω, when a relationship between the pressure difference Δp and the flow rate Q that has received an influence of the centrifugal force is previously obtained and the flow rate property function f of the filling flow path configuration unit is set at every the revolution speed ω, the flow rate Q can be accurately obtained.

In addition, since the flow characteristics of the filling flow path configuration unit 8 are considered to be slightly different from each of the filling flow path configuration units 8, it is preferable to prepare the flow rate property function f of the filling flow path configuration unit at each of the filling flow path configuration units 8.

Using the above-mentioned results, the filling control device 20 momentarily calculates (for example, every 1 ms) the flow rate Q (Δp, ω) of the liquid path 4 (the liquid outlet 4*b*) of each of the filling flow path configuration units 8 from the revolution speed ω of the revolution indicator 40, the detected pressure difference Δp from the pressure difference detector 30, and the flow rate property function f(Δp, ω) of the filling flow path configuration unit.

The filling control device 20 integrates and calculates the momentarily calculated flow rate (the flow rate between measurements), and closes the liquid valve 4*a* of the filling flow path configuration unit 8 when a value of the integrated and calculated result coincides with a preset target filling quantity, terminating the filling.

As described above, according to the above-mentioned configuration, even in a configuration in which the gaseous phase section 3*g* is formed at the liquid distribution chamber 3A, the filling quantity can be accurately controlled.

In addition, in the embodiment, while the liquid distribution chamber gas pressure control unit 100 is installed to regulate the pressure of the gaseous phase section 3*g* of the liquid distribution chamber 3A, when the pressure in the gaseous phase section 3*g* is not needed, the liquid distribution chamber gas pressure control unit 100 may be omitted to be released into the atmosphere.

In addition, like the second embodiment, instead of the pressure difference detector 30, the capillary tube type pressure difference detector 50 may be used.

[Eighth Embodiment]

Hereinafter, an eighth embodiment of the present invention will be described with reference to FIG. 16. In addition, in the following description and the drawings used for the description, the same components as those already described are designated by the same reference numerals, and overlapping description thereof will not be repeated.

While a rotary-type filling machine F8 has the same configuration as the rotary-type filling machine F5 of the fifth embodiment, the rotary-type filling machine F8 is distinguished from the rotary-type filling machine F5 in that a liquid distribution chamber (a gas return chamber) 3A has the gaseous phase section 3*g*, which is not filled with the liquid, the liquid distribution chamber gas pressure control unit 100 configured to regulate the pressure of the gaseous phase section 3*g* of the liquid distribution chamber 3A is provided, the liquid distribution chamber liquid level control unit 90 configured to control the liquid level of the liquid L in the liquid distribution chamber 3A is provided, and the pressurized gas path 6 is connected to the gaseous phase section 3*g* of the liquid distribution chamber 3A instead of the gaseous phase section 71*g* of the upper portion of the liquid reservoir section 71.

Figure 16:
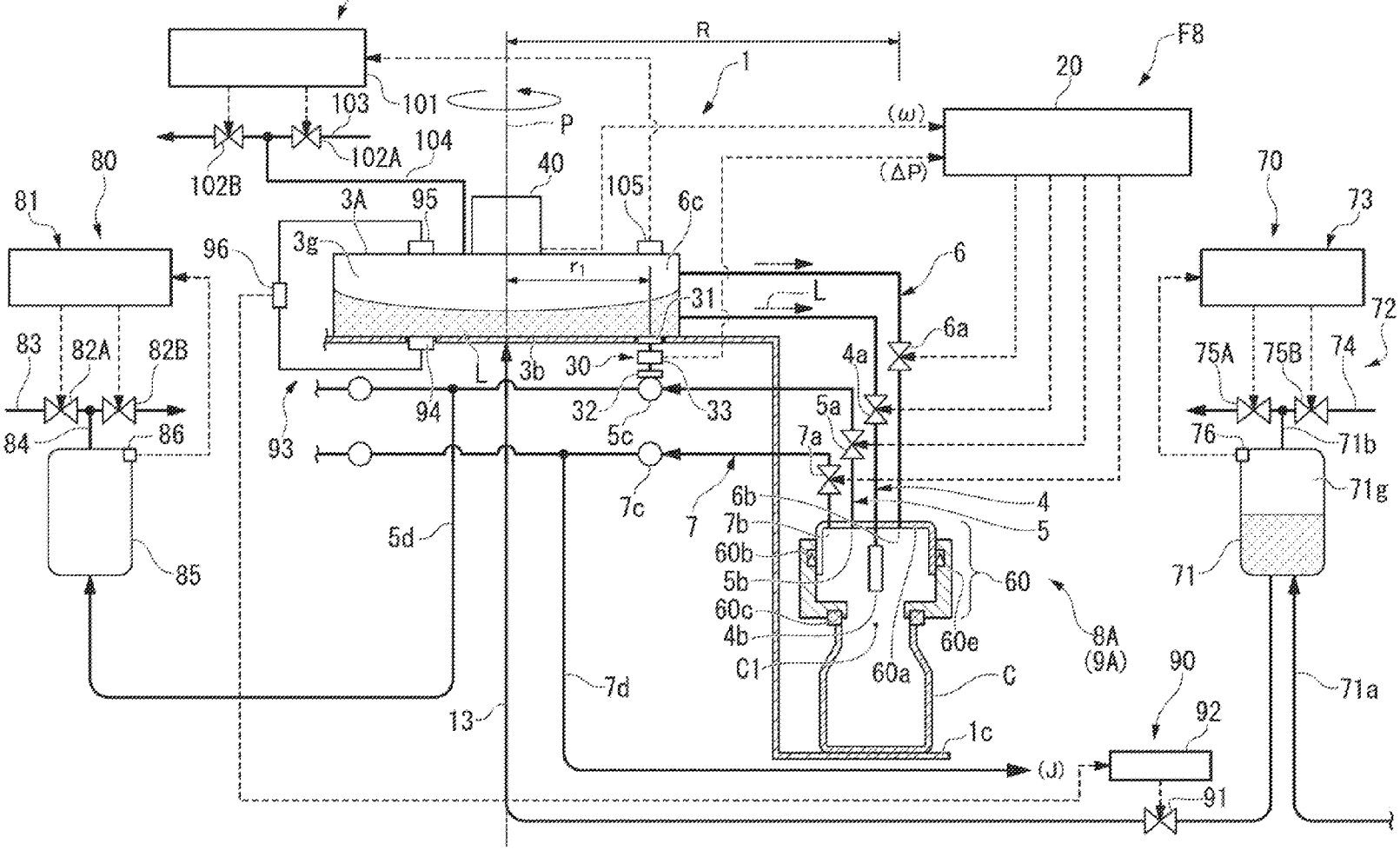
FIG. 16 is a schematic configuration view of a rotary-type filling machine F8 according to an eighth embodiment of the present invention.

As shown in FIG. 16, the pressure difference detector 30 is installed at a position where the radial direction distance r is apart from the rotation central axis P with an amount of r1 (the installation position r1) at the partition wall 3*b* configured to partition the liquid distribution chamber 3, and configured such that the first detection unit 31 receives the pressure from the liquid L of the liquid distribution chamber 3A and the second detection unit 32 receives the pressure from the gas of the return gas system manifold 5*c* at the installation position r1. Then, the detector main body 33 outputs the pressure difference Δp obtained by subtracting the pressure at the second detection unit 32 from the pressure at the first detection unit 31 to the filling control device 20.

According to the above-mentioned configuration, even when the gaseous phase section 3*g* is provided in the liquid distribution chamber 3A, the same operation as the above-mentioned fifth embodiment can be obtained, and the liquid L can be accurately filled.

Figure 17:
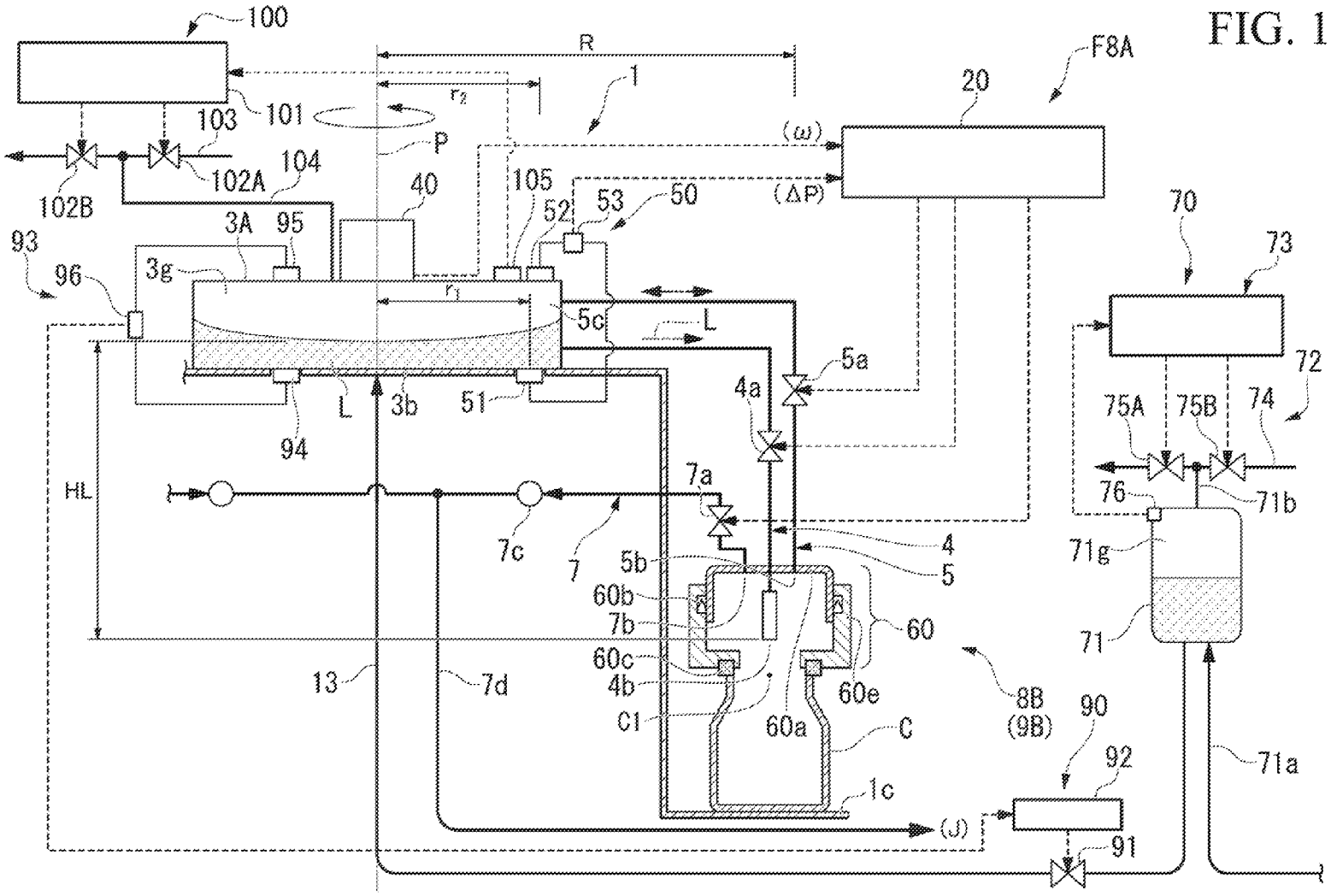
FIG. 17 is a view showing a rotary-type filling machine F8A, which is a modified example of the rotary-type filling machine F8 according to the eighth embodiment of the present invention.

FIG. 17 is a view showing a rotary-type filling machine F8A, which is a modified example of the rotary-type filling machine F8.

The rotary-type filling machine F8A is distinguished from the rotary-type filling machine F8 in that the pressurized gas path 6, the pressurized gas valve 6*a*, the return gas pressure control unit 80 and the return line 5*d* are omitted, and the return gas path 5 of the filling flow path configuration unit 8A is connected to the gaseous phase section 3*g* of the liquid distribution chamber 3A instead of the return gas system manifold 5*c*.

In addition, the liquid distribution chamber 3A is installed such that the liquid surface of the liquid L in the liquid distribution chamber is disposed higher than the liquid outlet 4*b* of the liquid path 4 of the filling flow path configuration unit 8A by the water head difference HL. The dimension and shape of the flow path of the liquid of the filling flow path configuration unit 8A are designed such that the required filling flow rate Q can be obtained by the pressure difference Δp before and after the filling flow path configuration unit 8A obtained based on the water head difference HL.

The rotary-type filling machine F8A is configured such that the pressurized gas is supplied into the closed space of the container C by the return gas path 5 and the return gas is collected into the gaseous phase section 3*g* of the liquid distribution chamber 3A.

In the case of the embodiment, as the pressurized gas path 6 and the return gas path 5 are shared, the structure of the rotary-type filling machine can be configured simply.

In the embodiment, an outlet of the return gas of the filling flow path configuration unit 8A is the gaseous phase section 3*g* of the liquid distribution chamber 3A instead of the return gas system manifold 5*c* in the rotary-type filling machine F8.

In addition, the rotary-type filling machine F8A has the pressure difference detector 50 instead of the pressure difference detector 30. More specifically, the first detection body 51 is disposed at the installation position r1 on the partition wall 3*b* of the liquid distribution chamber 3A, the second detection body 52 is disposed at the installation position r2 on the partition wall 3*a*, and the pressure of the gaseous phase section 3*g* of the liquid distribution chamber 3A, which is a flow release unit of the filling flow path configuration unit 8A of the embodiment, is detected as a return gas chamber pressure.

According to the modified example, like the rotary-type filling machine F6A of the sixth embodiment, the entire configuration of the apparatus can be more simplified.

In addition, while the configuration of the above-mentioned embodiment includes the pressure difference type liquid level gauge 93, the pressure difference type liquid level gauge 93 may be omitted by inputting the detected pressure difference Δp of the pressure difference detector 50 to the liquid level control device 92.

Further, an operation sequence of the above-mentioned embodiment, or shapes, combinations, or the like, of the respective members are exemplarily described, and may be variously modified based on design requirements or the like without departing from the scope of the present invention.

For example, in the flow rate calculation equation of the above-mentioned embodiments, while the pressure information and the rotation information are used as parameters to obtain the flow rate $Q=f(\Delta p, \omega)$, a liquid temperature T of the liquid L may be measured, and the flow rate $Q=f(\Delta p, \omega, T)$ may be calculated using the liquid temperature T as a parameter as well.

In addition, in the above-mentioned embodiment, while the liquid distribution chambers 3 and 3A are formed in a columnar shape, another shape such as an annular shape may be used.

Further, in the above-mentioned embodiment, while the container C is still standing on the seating table 1*c* and the elevation member 60*e* of the sealing tool 60 is elevated without elevating the container C, the sealing tool 60 may be stopped and the apparatus on which the container C is placed may be elevated.

REFERENCE SIGNS LIST

1 rotary body
3, 3A liquid distribution chamber
5*c* return gas system manifold (return gas chamber)
8, 8A filling flow path configuration unit
20 filling control device
30, 50 pressure difference detector (pressure difference information detection unit)
40 revolution indicator (rotation information detection unit)
51 first detection body
51*a* capillary tube
51*b* capillary tube
52 second detection body
53 detector main body
60 sealing tool
70 liquid supply unit
80 return gas pressure control unit
90 liquid distribution chamber liquid level control unit
100 liquid distribution chamber gas pressure control unit
F1, F2, F3, F4, F5, F6, F6A, F6B, F7, F8, F8A rotary-type filling machine
C container
J atmosphere
L liquid
P rotation central axis
Q flow rate
R radial direction distance

The invention claimed is:

1. A rotary-type filling machine comprising:

a rotary body rotatable about a rotation central axis;

a liquid distribution chamber that has a cylindrical shape and is configured to store a liquid supplied from an outside of the rotary body, the center of the liquid distribution chamber being coincident with the rotation central axis of the rotary body;

a plurality of filling flow path configuration units arranged about the rotation central axis in the rotary body, each of which has a fluid path constituted by a liquid path connected to the liquid distribution chamber and a liquid valve installed at the liquid path and configured to individually introduce the liquid into a container;

a filling control device configured to control the respective liquid valves and control a filling quantity of the liquid with respect to the container;

a liquid supply unit installed at a fixing section and configured to supply the liquid into the liquid distribution chamber;

a pressure difference information detection unit provided radially outside the liquid distribution chamber, and configured to detect pressure difference information between a liquid distribution chamber pressure, which is a pressure of the liquid in the liquid distribution chamber and which includes a centrifugal force caused by a rotation of the rotary body, and a filling atmospheric pressure detected as a pressure of a flow release unit in the filling flow path configuration unit at an arbitrary radial direction position of the rotary body, and a rotation information detection unit configured to detect rotation information of the rotary body, wherein the filling control device calculates a flow rate of the liquid flowing out of a liquid outlet of the liquid path based on the detected pressure difference information, rotation information and a previously obtained relationship between the pressure difference information and rotation information and the flow rate of the liquid flowing out of the liquid outlet of the liquid path, and controls a filling quantity of the liquid with respect to the container.

2. A rotary-type filling machine comprising:

a rotary body rotatable about a rotation central axis;

a liquid distribution chamber that has a cylindrical shape and is configured to store a liquid supplied from an outside of the rotary body, the center of the liquid distribution chamber being coincident with the rotation central axis of the rotary body;

a plurality of filling flow path configuration units arranged about the rotation central axis in the rotary body, each of which has a fluid path constituted by a liquid path connected to the liquid distribution chamber and a liquid valve installed at the liquid path and configured to individually introduce the liquid into a container;

a filling control device configured to control the respective liquid valves and control a filling quantity of the liquid with respect to the container;

a liquid supply unit installed at a fixing section and configured to supply the liquid into the liquid distribution chamber; and a pressure difference information detection unit provided radially outside the liquid distribution chamber, and configured to detect pressure difference information between a liquid distribution chamber pressure, which is a pressure of the liquid in the liquid distribution chamber and which includes a centrifugal force caused by a rotation of the rotary body, and a filling atmospheric pressure of the container detected as a pressure of a flow release unit in the filling flow path configuration unit at substantially the same radial direction position as a liquid outlet of the liquid path of the rotary body, wherein the filling control device calculates a flow rate of the liquid flowing from the liquid outlet of the liquid path based on the detected pressure difference information and a previously obtained relationship between the pressure difference information and the flow rate of the liquid flowing from the liquid outlet of the liquid path, and controls a filling quantity of the liquid with respect to the container.

3. A rotary-type filling machine comprising:

a rotary body rotatable about a rotation central axis;

a liquid distribution chamber that has a cylindrical shape and is configured to store a liquid supplied from an outside of the rotary body, the center of the liquid distribution chamber being coincident with the rotation central axis of the rotary body;

a plurality of filling flow path configuration units arranged about the rotation central axis in the rotary body, each of which has a fluid path constituted by a liquid path connected to the liquid distribution chamber and a liquid valve installed at the liquid path, a sealing tool configured to seal a filling atmosphere in a container, a return gas path configured to guide a return gas during the filling from the container into a return gas chamber which is pressure-controlled and a return gas valve installed at the return gas path, and configured to individually guide a liquid into the container;

a pressurized gas path configured to supply a pressure-controlled gas with respect to the container and a pressurized gas valve installed at the pressurized gas path;

a discharge gas path configured to discharge a pressurized gas remaining in the container and the sealing tool upon completion of the filling and a discharge gas valve installed at the discharge gas path;

a filling control device configured to control the respective liquid valves and control a filling quantity of the liquid with respect to the container;

a liquid supply unit installed at a fixing section and configured to supply the liquid into the liquid distribution chamber;

a pressure difference information detection unit provided radially outside the liquid distribution chamber, and configured to detect pressure difference information between a liquid distribution chamber pressure, which is a pressure of the liquid in the liquid distribution chamber and which includes a centrifugal force caused by a rotation of the rotary body, and a return gas chamber pressure of the return gas chamber detected as a pressure of a flow release unit in the filling flow path configuration unit at an arbitrary radial direction position of the rotary body; and a rotation information detection unit configured to detect rotation information of the rotary body, wherein the filling control device calculates a flow rate of the liquid flowing out of a liquid outlet of the liquid path based on the detected pressure difference information, rotation information and a previously obtained relationship between the pressure difference information and rotation information and the flow rate of the liquid flowing out of the liquid outlet of the liquid path, and controls a filling quantity of the liquid with respect to the container.

4. A rotary-type filling machine comprising:

a rotary body rotatable about a rotation central axis;

a liquid distribution chamber that has a cylindrical shape and is configured to store a liquid supplied from the outside of the rotary body, the center of the liquid distribution chamber being coincident with the rotation central axis of the rotary body;

a plurality of filling flow path configuration units arranged about the rotation central axis in the rotary body, each of which has a fluid path constituted by a liquid path connected to the liquid distribution chamber and a liquid valve installed at the liquid path, a sealing tool configured to seal a filling atmosphere in a container, a return gas path configured to guide a return gas during the filling from the container into a return gas chamber which is pressure-controlled and a return gas valve installed at the return gas path, and configured to individually guide a liquid into the container;

a pressurized gas path configured to supply a pressure-controlled gas with respect to the container and a pressurized gas valve installed at the pressurized gas path;

a discharge gas path configured to discharge a pressurized gas remaining in the container and the sealing tool upon completion of the filling and a discharge gas valve installed at the discharge gas path;

a filling control device configured to control the respective liquid valves and control a filling quantity of the liquid with respect to the container;

a liquid supply unit installed at a fixing section and configured to supply the liquid into the liquid distribution chamber; and a pressure difference information detection unit provided radially outside the liquid distribution chamber, and configured to detect pressure difference information between a liquid distribution chamber pressure, which is a pressure of the liquid in the liquid distribution chamber and which includes a centrifugal force caused by a rotation of the rotary body, and a return gas chamber pressure of the return gas chamber detected as a pressure of a flow release unit in the filling flow path configuration unit at substantially the same radial direction position as a liquid outlet of the liquid path of the rotary body, wherein the filling control device calculates a flow rate of the liquid flowing from the liquid outlet of the liquid path based on the detected pressure difference information and a previously obtained relationship between the pressure difference information and the flow rate of the liquid flowing from the liquid outlet of the liquid path, and controls a filling quantity of the liquid with respect to the container.

5. The rotary-type filling machine according to Claim 1, wherein the liquid distribution chamber is filled with the liquid.

6. The rotary-type filling machine according to Claim 1, wherein a liquid phase by the liquid and a gaseous phase by a gas are formed in the liquid distribution chamber, and a liquid level control unit configured to control a liquid level of the liquid in the liquid distribution chamber is provided between the liquid distribution chamber and the liquid supply unit.

7. The rotary-type filling machine according to Claim 1, wherein the pressure difference information detection unit comprises:

a first detection body installed at the liquid distribution chamber and configured to detect the liquid distribution chamber pressure;

a second detection body installed at the rotary body spaced apart from the first detection body, and configured to detect a pressure of the flow release unit of the filling flow path configuration unit;

a pair of capillary tubes connected to the first detection body and the second detection body, and in which an enclosed liquid is sealed, respectively; and a detector main body configured to output a difference between a pressure transmitted from the first detection body and a pressure transmitted from the second detection body as the pressure difference information via the pair of capillary tubes.

8. The rotary-type filling machine according to Claim 1, wherein the pressure difference information detection unit comprises:

a first detection unit installed at the liquid distribution chamber and configured to detect the liquid distribution chamber pressure; and a second detection unit installed at substantially the same radial direction position as the first detection unit and configured to detect a pressure of the flow release unit of the filling flow path configuration unit.

9. A method of calculating a filling quantity for a rotary-type filling machine, wherein the machine includes:

a rotary body rotatable about a rotation central axis;

a liquid distribution chamber that has a cylindrical shape and is configured to store a liquid supplied from the outside of the rotary body, the center of the liquid distribution chamber being coincident with the rotation central axis of the rotary body;

a plurality of filling flow path configuration units arranged about the rotation central axis in the rotary body, each of which has a fluid path constituted by a liquid path connected to the liquid distribution chamber and a liquid valve installed at the liquid path and configured to individually introduce the liquid into a container; and a liquid supply unit installed at a fixing section and configured to supply the liquid into the liquid distribution chamber, the method comprising:

an information detecting process of detecting pressure difference information between a pressure of an inlet side of a flow in the filling flow path configuration unit and a pressure of a release side of the flow of a flow release unit side in the filling flow path configuration unit, and rotation information of the rotary body; and a calculating process of obtaining a flow rate of the liquid flowing from a liquid outlet of the liquid path based on the detected pressure difference information and rotation information, a previously obtained relationship between the pressure difference information and rotation information and the flow rate of the liquid flowing from the liquid outlet of the liquid path, wherein the flow rate includes an increased flow rate by a centrifugal force of the rotary body.

10. A method of calculating a filling quantity for a rotary-type filling machine, wherein the machine includes:

a rotary body rotatable about a rotation central axis;

a liquid distribution chamber that has a cylindrical shape and is configured to store a liquid supplied from an outside of the rotary body, the center of the liquid distribution chamber being coincident with the rotation central axis of the rotary body;

a plurality of filling flow path configuration units arranged about the rotation central axis in the rotary body, each of which has a fluid path constituted by a liquid path connected to the liquid distribution chamber and a liquid valve installed at the liquid path and configured to individually introduce the liquid into a container; and a liquid supply unit installed at a fixing section and configured to supply the liquid into the liquid distribution chamber, the method comprising:

an information detecting process of detecting pressure difference information between a pressure of an inlet side of a flow in the filling flow path configuration unit and a pressure of a release side of a flow of a flow release unit side in the filling flow path configuration unit at substantially the same radial direction position as an outlet of the liquid path; and a calculating process of obtaining a flow rate of the liquid flowing from a liquid outlet of the liquid path based on the detected pressure difference information, and a previously obtained relationship between the pressure difference information and the flow rate of the liquid flowing from the liquid outlet of the liquid path, wherein the flow rate includes an increased flow rate by a centrifugal force of the rotary body.

* * * * *